US007568923B2

(12) United States Patent
Fukatsu et al.

(10) Patent No.: US 7,568,923 B2
(45) Date of Patent: Aug. 4, 2009

(54) CONNECTOR AND CONNECTOR ASSEMBLY

(75) Inventors: Yukihiro Fukatsu, Yokkaichi (JP); Toshikazu Sakurai, Yokkaichi (JP); Youjirou Hashimoto, Yokkaichi (JP); Yasushi Okayasu, Yokkaichi (JP); Masaya Horiuchi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/136,111

(22) Filed: Jun. 10, 2008

(65) Prior Publication Data

US 2008/0248665 A1 Oct. 9, 2008

Related U.S. Application Data

(62) Division of application No. 11/636,342, filed on Dec. 8, 2006, now Pat. No. 7,431,596.

(30) Foreign Application Priority Data

Dec. 8, 2005 (JP) ..... 2005-355020
Feb. 28, 2006 (JP) ..... 2006-052592

(51) Int. Cl.
*H01R 13/62* (2006.01)

(52) U.S. Cl. ..... 439/154

(58) Field of Classification Search ..... 439/154, 439/257, 259, 347
See application file for complete search history.

(56) References Cited

U.S. PATENT DOCUMENTS 5,823,807 A 10/1998 Yamasaki et al.
5,876,226 A * 3/1999 Tsukakoshi et al. ..... 439/157
5,888,080 A 3/1999 Maejima
5,928,011 A 7/1999 Flask et al.
6,244,880 B1 6/2001 Fukase et al.
6,254,407 B1 7/2001 Burns
6,305,957 B1 10/2001 Fink et al.
6,666,697 B2 12/2003 Yamashita
6,890,194 B2 5/2005 Katsuma
6,960,090 B2 11/2005 Denter et al.
7,063,547 B2 6/2006 Toyoda et al.
7,097,476 B2 8/2006 Morikawa et al.

* cited by examiner

*Primary Examiner*—Phuong K Dinh
(74) *Attorney, Agent, or Firm*—Gerald E. Hespos; Anthony J. Casella

(57) ABSTRACT

A connector has a first housing (1) and a second housing (2) with a receptacle (4) for receiving the first housing (1). A slider (3) having a cam groove (24) is mounted in the first housing (1) for movement normal to connecting directions of the housings (1, 2). A cam (8) projects in the receptacle (4), and is movable along the cam groove (24). A mold removal hole (5A) for molding the cam (8) is formed in a back wall (5) of the receptacle (4), and a mold removal space (S) is between the cam (8) and the mold removal hole (5A). The slider (3) includes a deformable portion (25) that slides in contact with a slider insertion hole (11) while being deformed during connection of the housings (1, 2), and is restored resiliently in the mold removal space (S) when the housings (1, 2) are connected.

11 Claims, 38 Drawing Sheets

CONNECTOR AND CONNECTOR ASSEMBLY

This application is a divisional of U.S. patent application Ser. No. 11/636,342 filed Dec. 8, 2006.

BACKGROUND OF THE INVENTION

1. Field of the Invention

The invention relates to a connector and to a connector assembly.

2. Description of the Related Art

U.S. Pat. No. 7,063,547 discloses a connector assembly with first and second housings that can be connected with one another. A lever is mounted rotatably on the first housing and is formed with a cam groove for engaging a cam pin on the second housing. The cam groove and the cam pin cooperate when the lever is rotated to move the housings together or apart. A resilient piece is provided for holding the lever at an initial position so that the cam pin can be received into the cam groove. Other known connectors include a slider as a force-multiplying mechanism instead of a lever. Specifically, the slider is mounted to a female housing and is formed with a cam groove that engages a cam pin in a receptacle of a male housing. The male and female housings are connected by sliding the slider. A resilient piece is engaged with the female housing for holding the slider at an initial position, and such an engagement is canceled upon connecting the two housings.

The resilient piece is deformed during a connecting operation of the two housings in the above-described connector assemblies. A resilient piece that remains deformed after completion of the connecting operation could be set permanently in fatigue. Thus, the resilient piece should be restored resiliently as the connecting operation is completed. A special space has been provided in the female housing for restoration of the resilient piece, thereby hindering miniaturization of the female housing.

U.S. Pat. No. 7,097,476 discloses a connector with a female housing, a male housing and a slider that can be operated to connect and separate the two housings. The slider is moved in directions intersecting connecting directions of the two housings. The slider is formed with a cam groove, and the male housing has a cam pin engageable with the cam groove. The housings are fit lightly together with the slider held at a partial locking position in the female housing and with the cam pin engaged in the cam groove. The slider then is pushed to a full locking position. As a result, a cam action of the cam groove and the cam pin pulls the housings to a properly connected state.

A moving direction of the above-described slider intersects a force acting direction. Thus, this type of slider is not likely to separate from the housings even if wires are pulled while the housings are connected properly. In many cases, the slider has a locking section for holding the slider at the partial locking position and at the full locking position in the housing, but with no lock arm for locking the slider and the housing together.

Thought has been given to providing a slider with a lock arm to deal with an unpredictable situation. Such a lock arm would be resiliently deformable and engageable with a lock on the housing. The slider with the lock arm is inserted into a housing with the lock arm deformed. The lock arm returns resiliently to engage the lock when the slider reaches a proper insertion position. Thus, the slider and the housing are locked together. The lock arm can be pressed to cancel the locked state so that the slider can be pulled out. However, external matter could interfere directly with the lock arm, and could break, chip or deform the lock arm. Further, the slider is difficult to separate because the operable portion of the resiliently deformable lock arm is unstable if an attempt is made to pull the slider out while keeping the slider unlocked.

The invention was developed in view of the above situation, and an object thereof is to improve the overall operability of a connector and connector assembly, in particular allowing a miniaturization a connector and connector assembly as a whole.

SUMMARY OF THE INVENTION

The invention relates to a connector assembly with first and second housings. The first housing is formed with an escaping groove that extends in forward and backward directions. The second housing has a receptacle for receiving the first housing. The connector assembly also has a movable member, such as a slider, formed with a cam groove. The slider is mounted movably into a slider insertion hole that extends from the opposite side surfaces of the first housing to the escaping groove in directions substantially normal to connecting directions of the two housings. A follower pin projects inward from the inner peripheral surface of the receptacle and is movable forward along the escaping groove and along the cam groove when the two housings are connected. A mold removal hole is formed in a back wall of the receptacle to mold the follower pin, and a mold removal space is defined between the follower pin and the mold removal hole. The slider includes a resiliently deformable locking section. The locking section engages the first housing to enable the slider to be mounted in the first housing at a position so that the cam groove can receive the follower pin. The locking section can be moved in sliding contact with the inner surface of the slider insertion hole while being resiliently deformed during a connecting operation of the housings, and is restored resiliently in the mold removal space when the housings are connected properly. Accordingly, the mold removal space is used positively and the connector assembly can be miniaturized by omitting a special space for resilient restoration.

An opening preventing portion is provided in the escaping groove and is formed to engage the follower pin at least during the connection of the two housings. Thus, a surface of the receptacle where the follower pin is formed is prevented from opening, and the cam groove and the follower pin can be kept engaged during the connecting operation of the two housings.

The opening preventing portion preferably engages the follower pin from the start of the connecting operation of the two housings substantially to the proper connection of the two housings. Accordingly, a connection guiding function is exhibited in addition to the opening preventing function.

The slider or other such movable member preferably has at least one main body formed with at least one cam means engageable with a mating cam means of the mating housing, and movable with respect to the housing in directions that intersect connecting directions of the housings. The movable member is moved by operating a rear part of the movable member with respect to the operating direction. The movable member includes at least one lock arm defining a deformation space to the main body. The lock arm is resiliently deformable along the movable member main body, and is unlocked by being pushed towards the deformation space. The housing includes at least one lock that is engageable with the lock arm upon the completion of the operation of the movable member. At least one cover is provided at a back side of the movable member with respect to the operation direction. The cover at least partly covers the movable member from behind with respect to the operation direction of the movable member and protects the lock arm from external matter. The cover also serves as a pushable wall to operate the movable member. Therefore, it is not necessary to provide a pushable portion to operate the movable member in addition to the cover and the construction can be simplified. The cover is formed by extending a part for covering the lock arm from a preexisting pushable portion to achieve an enlarged pushable surface. Therefore, the operable member can be operated more easily.

The movable member preferably is a slider that can be inserted in and withdrawn from the housing in directions intersecting with connecting directions of the connector housing with the mating connector housing.

The slider preferably is inserted into the housing by pushing a rear part of the slider with respect to an inserting direction and the housing includes at least one lock engageable with the respective lock arm upon the completion of the insertion of the slider.

The movable member preferably is substantially plate-like and the lock arm is deformable in a direction along the plate surface of the main body.

The lock arm preferably includes at least one hand-push portion used to push the lock arm. The hand-push portion is at a position of the lock arm near the cover and has a height to project more than the leading edge of the cover in a direction opposite to the resiliently deforming direction of the lock arm. A finger that has pushed the hand-push portion during unlocking is supported on the leading edge of the cover. Thus, the movable member can be pulled out more easily by placing the finger on the cover, which is a fixed wall.

Finger placing surfaces preferably are formed on both a projecting end of the hand-push portion and the leading edge of the cover, and preferably have a substantially continuous downward slope towards the front with respect to the operating direction of the movable member when the lock arm is pushed for unlocking. Accordingly, the fingers can be placed better, and the movable member can be operated easily.

The finger placing surface of the hand-push portion preferably has an uneven surface to prevent the fingers from slipping. Accordingly, the movable member can be operated more easily.

An inclined surface preferably is formed on the rear side of a part of the hand-push portion that projects more than the leading edge of the cover with respect to the operating direction of the movable member. The inclined surface creates a component of force to displace the lock arm towards the deformation space when an external force acts thereon in a direction substantially along the operating direction of the movable member. An external force could displace the lock arm in a direction opposite the specified deforming direction if there was no inclined surface, and the lock arm could be broken by continuously receiving such an external force. However, the above-described inclined surface ensures that the lock arm will escape towards the deformation space in the specified resiliently deforming direction.

The lock arm and the main body of the movable member preferably are coupled by at least one coupling that permits the lock arm to be deformed resiliently and that prevents the lock arm from being plastically deformed in a direction away from the deformation space. Accordingly, an excessive deformation of the lock arm can be prevented even if, for example, a wire or the like is caught between the lock arm and the main body of the movable member. Therefore, the lock arm will not be damaged by an excessive displacement caused by the interference of an external matter.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
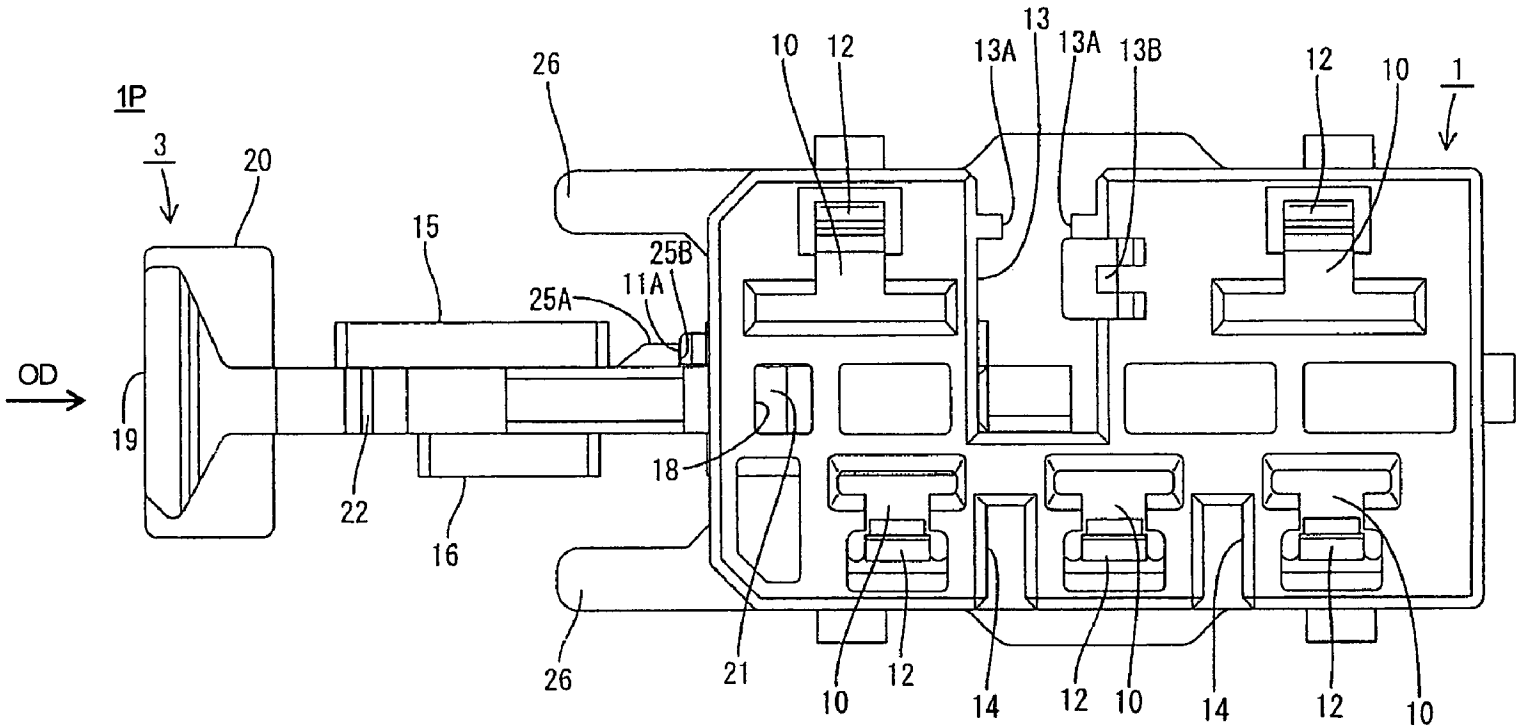
FIG. 1 is a front view of one embodiment of the invention showing a forward-movement preventing portion engaged with a partial locking interacting surface of a first housing when a slider is at a partial locking position.
Figure 2:
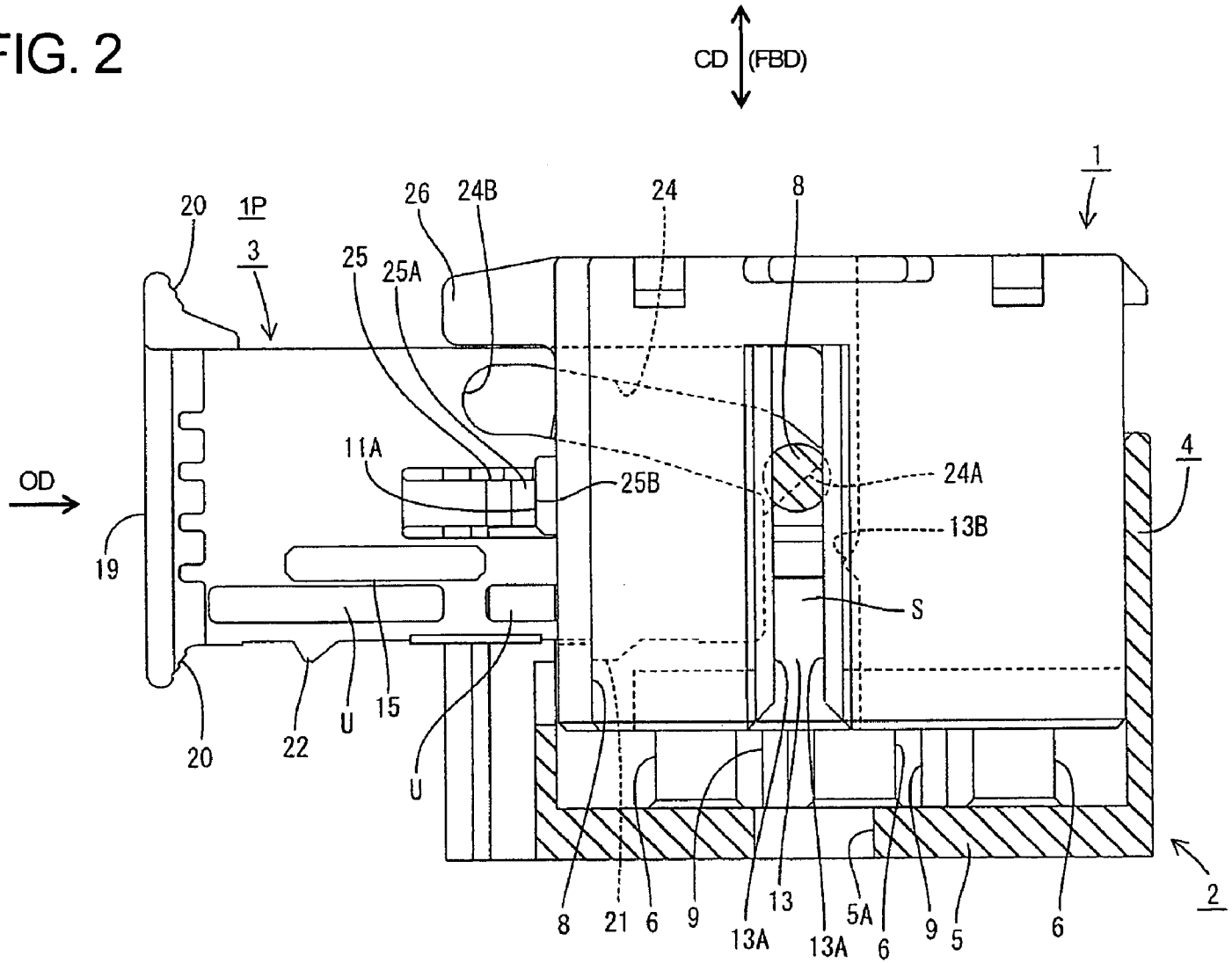
FIG. 2 is a plan view partly in section showing the state of FIG. 1.
Figure 3:
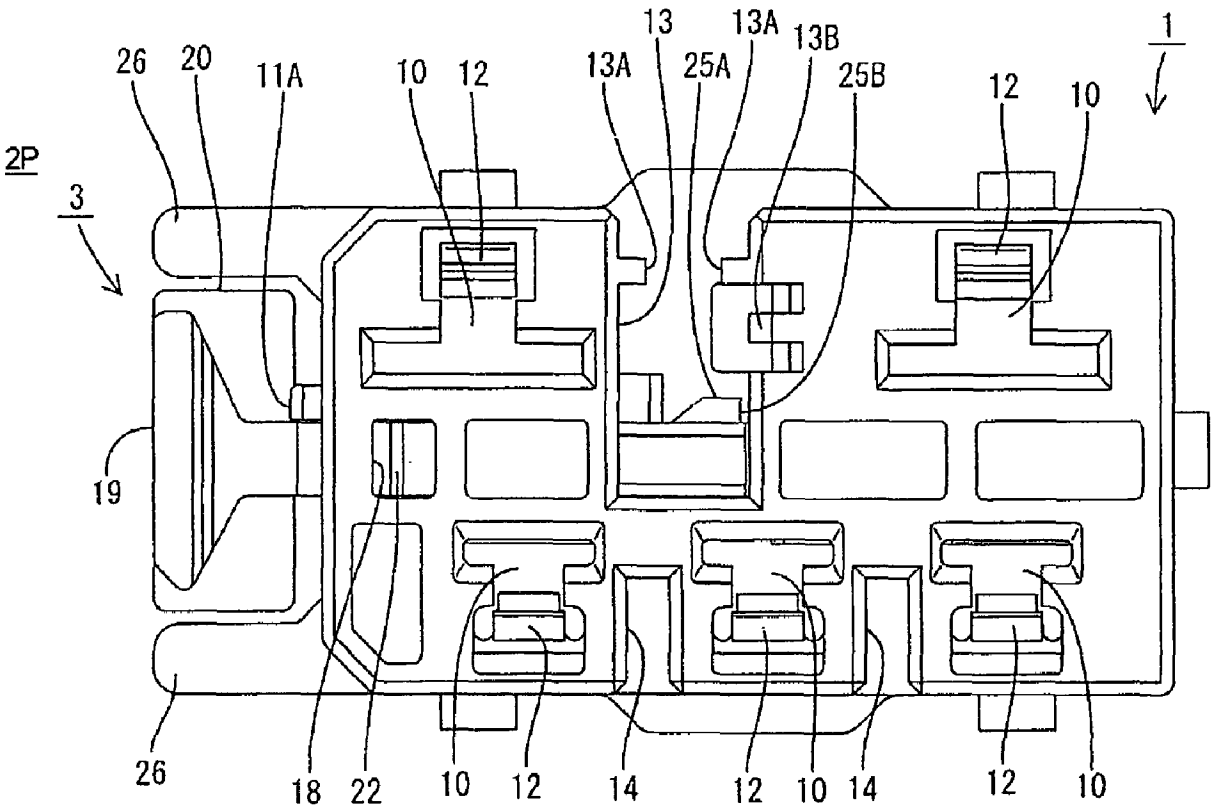
FIG. 3 is a front view showing the slider at a full locking position.
Figure 4:
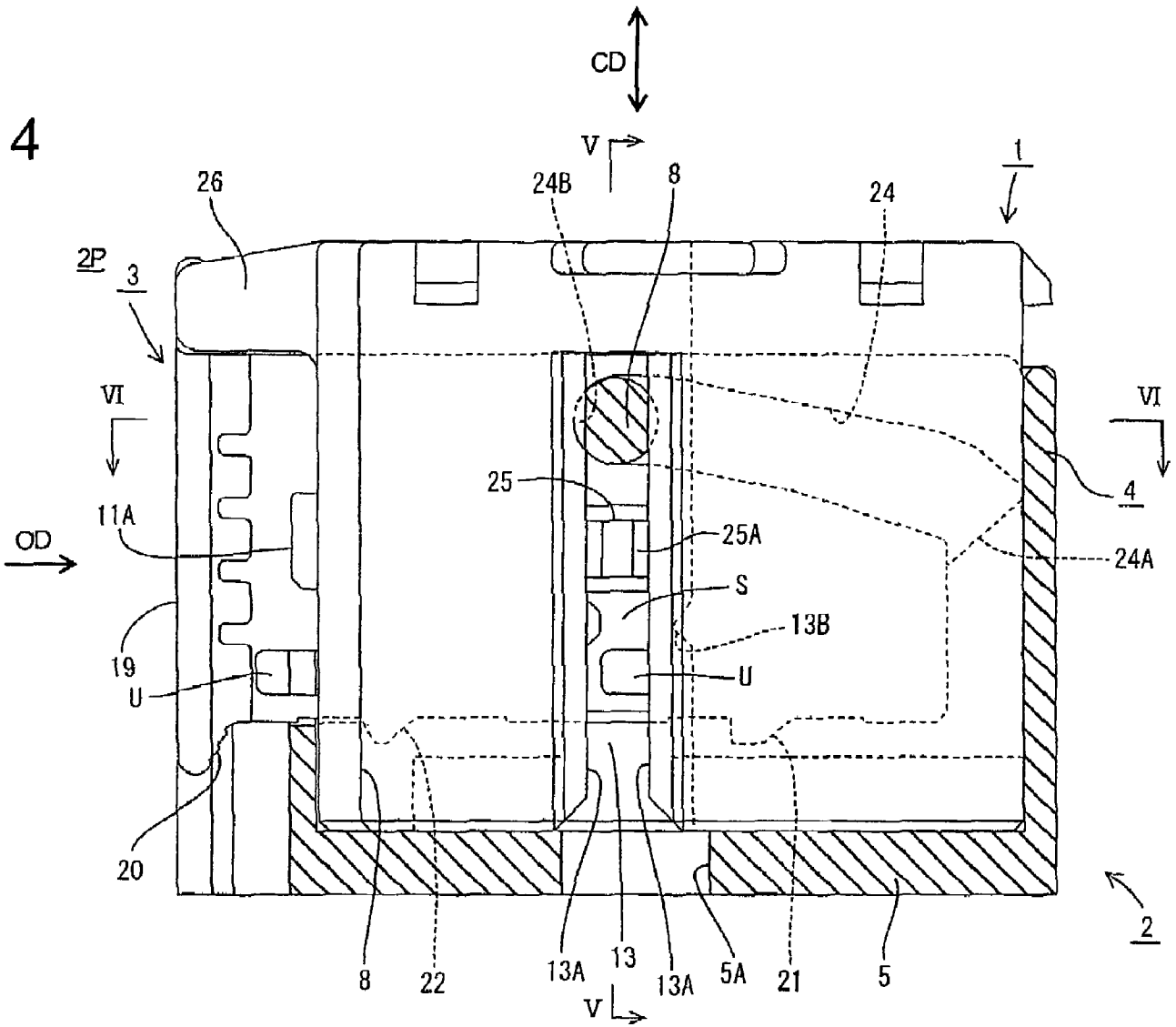
FIG. 4 is a plan view partly in section showing the state of FIG. 3.

A first embodiment of the invention is described with reference to FIGS. 1 to 18. As shown in FIG. 2, a connector according to this embodiment is provided with a first housing 1, a second housing 2 and a slider 3, and the two housings 1, 2 are connected by operating the slider 3 in a direction OD substantially normal to connecting directions CD thereof. Ends of the two housings 1, 2 to be connected in the connecting directions CD are referred to as front ends concerning forward and backward directions FBD.

Figure 8:
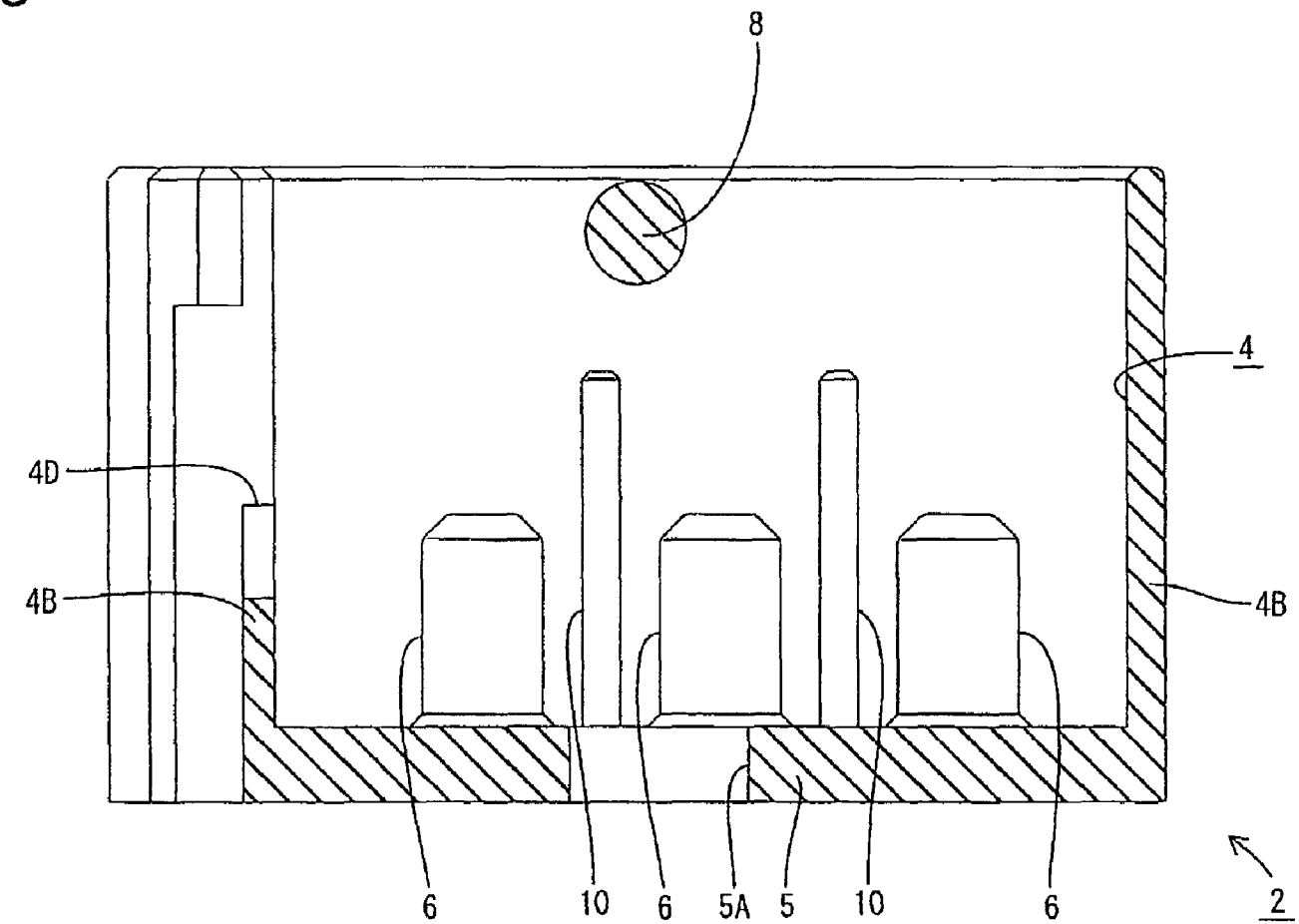
FIG. 8 is a section along VIII-VIII of FIG. 10.
Figure 10:
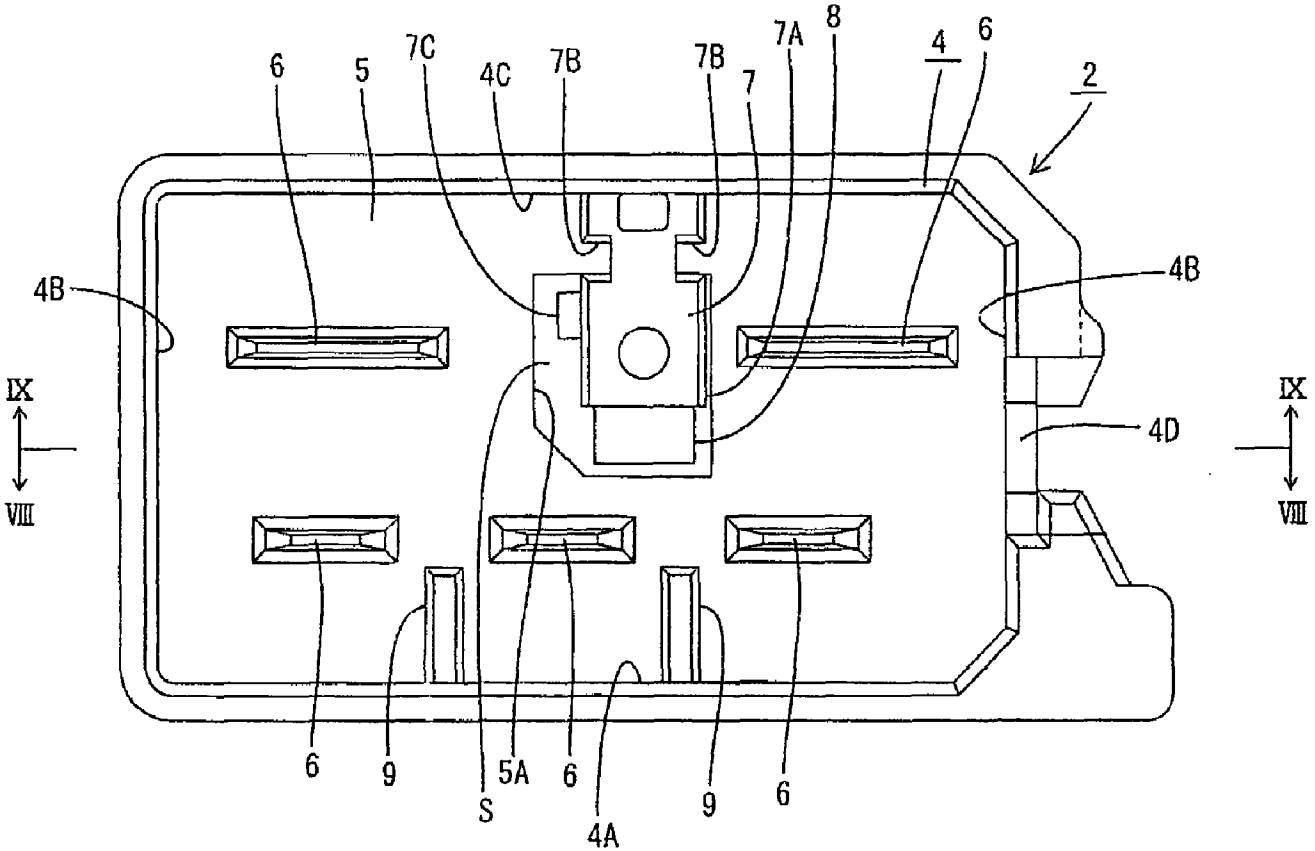
FIG. 10 is a front view of a second housing.
Figure 11:
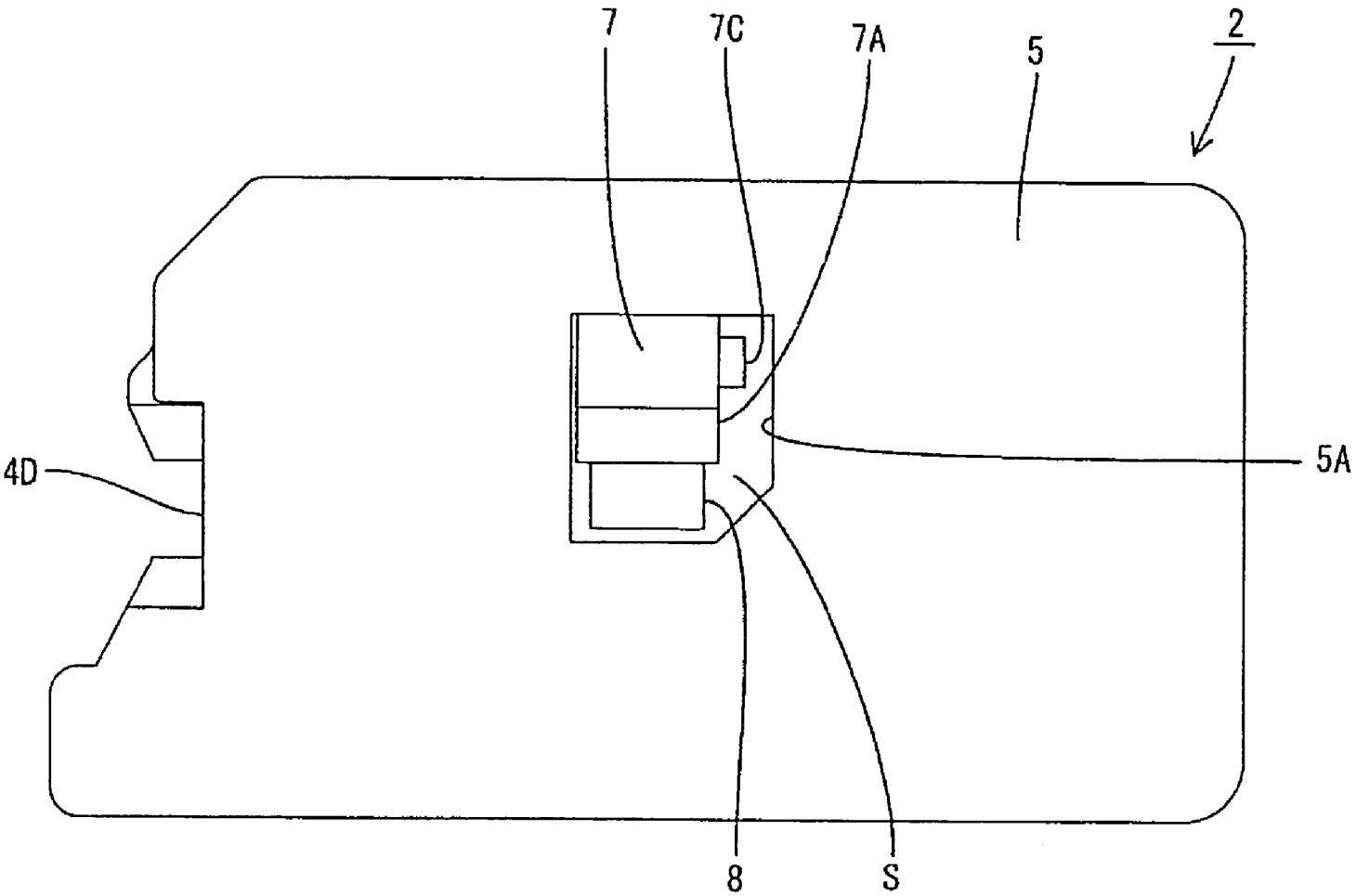
FIG. 11 is a rear view of the second housing.

The second housing 2 is made e.g. of a synthetic resin and has a receptacle 4 with an open front end, as shown in FIG. 8. A cut is made in a left wall 4B of the receptacle 4 and extends back from the opening edge of the receptacle 4 to form a notch 4D for avoiding interference with the slider 3 during connection of the housings 1, 2. As shown in FIG. 10, male terminal fittings 6 project forward from a back wall 5 of the receptacle 4 at upper and lower stages. The male terminal fittings 6 at the upper stage are wider than those at the lower stage.

Figure 5:
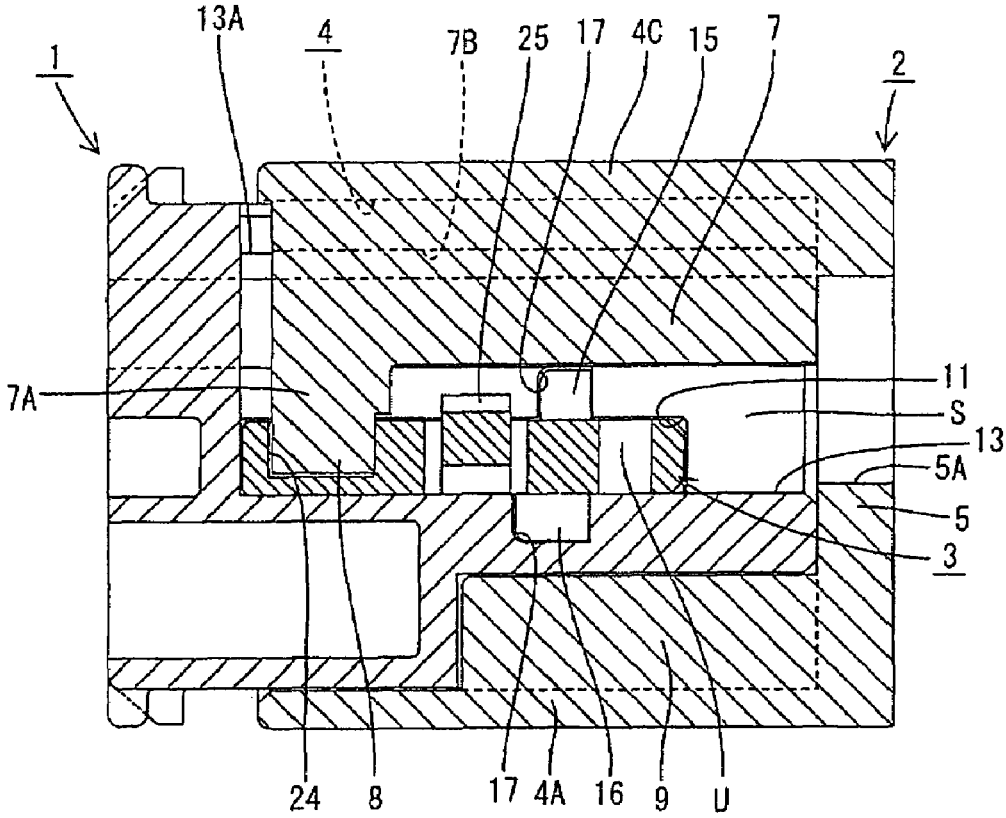
FIG. 5 is a section along V-V of FIG. 4.
Figure 6:
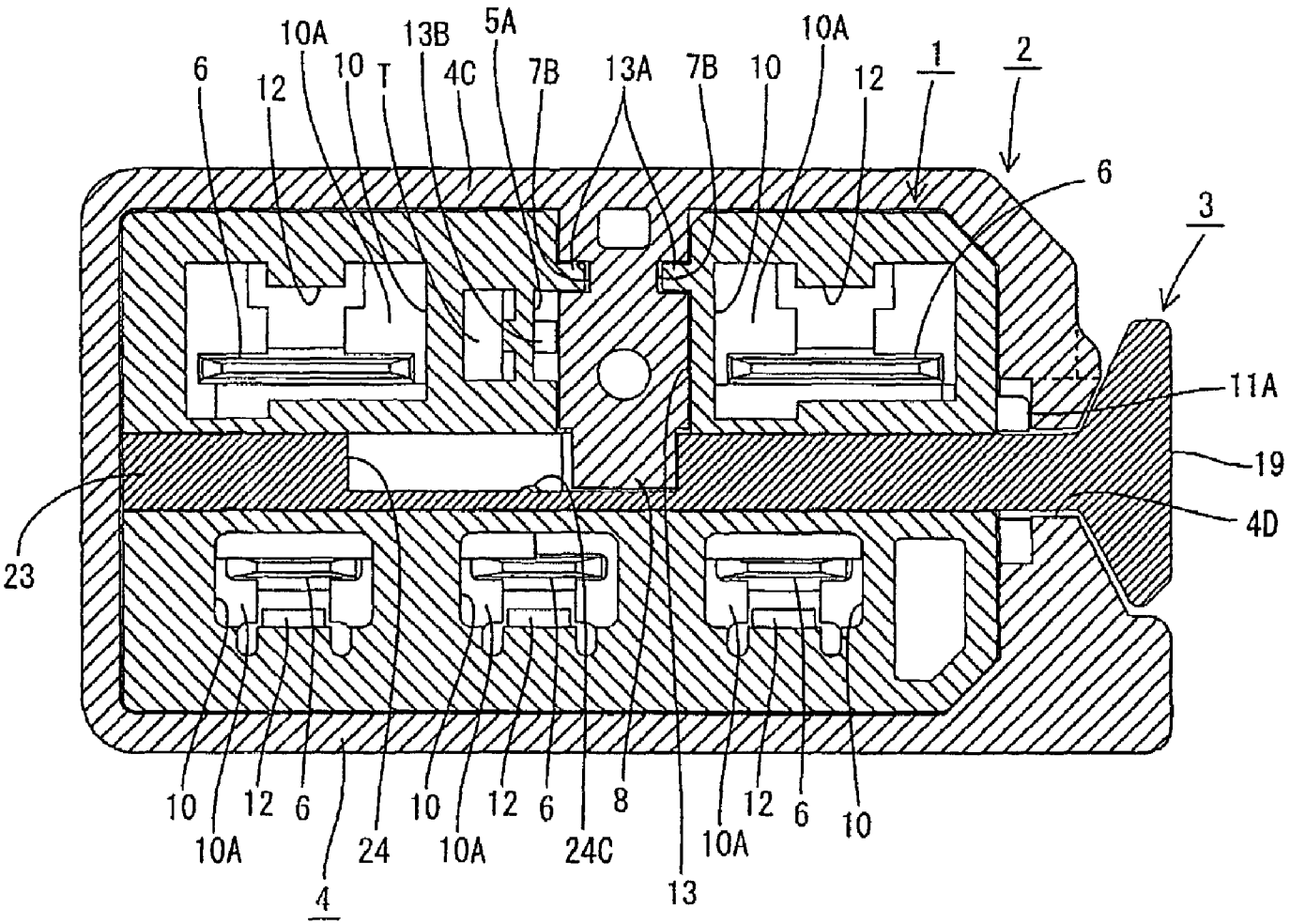
FIG. 6 is a section along VI-VI of FIG. 4.
Figure 7:
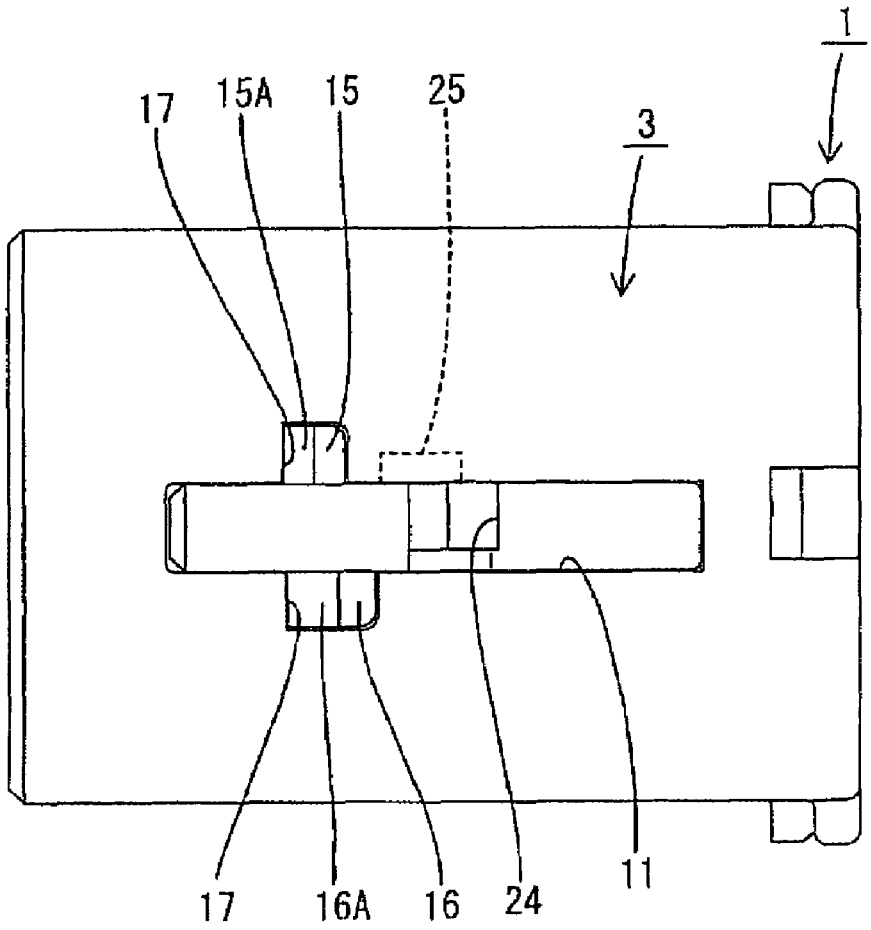
FIG. 7 is a right side view of the connector.
Figure 9:
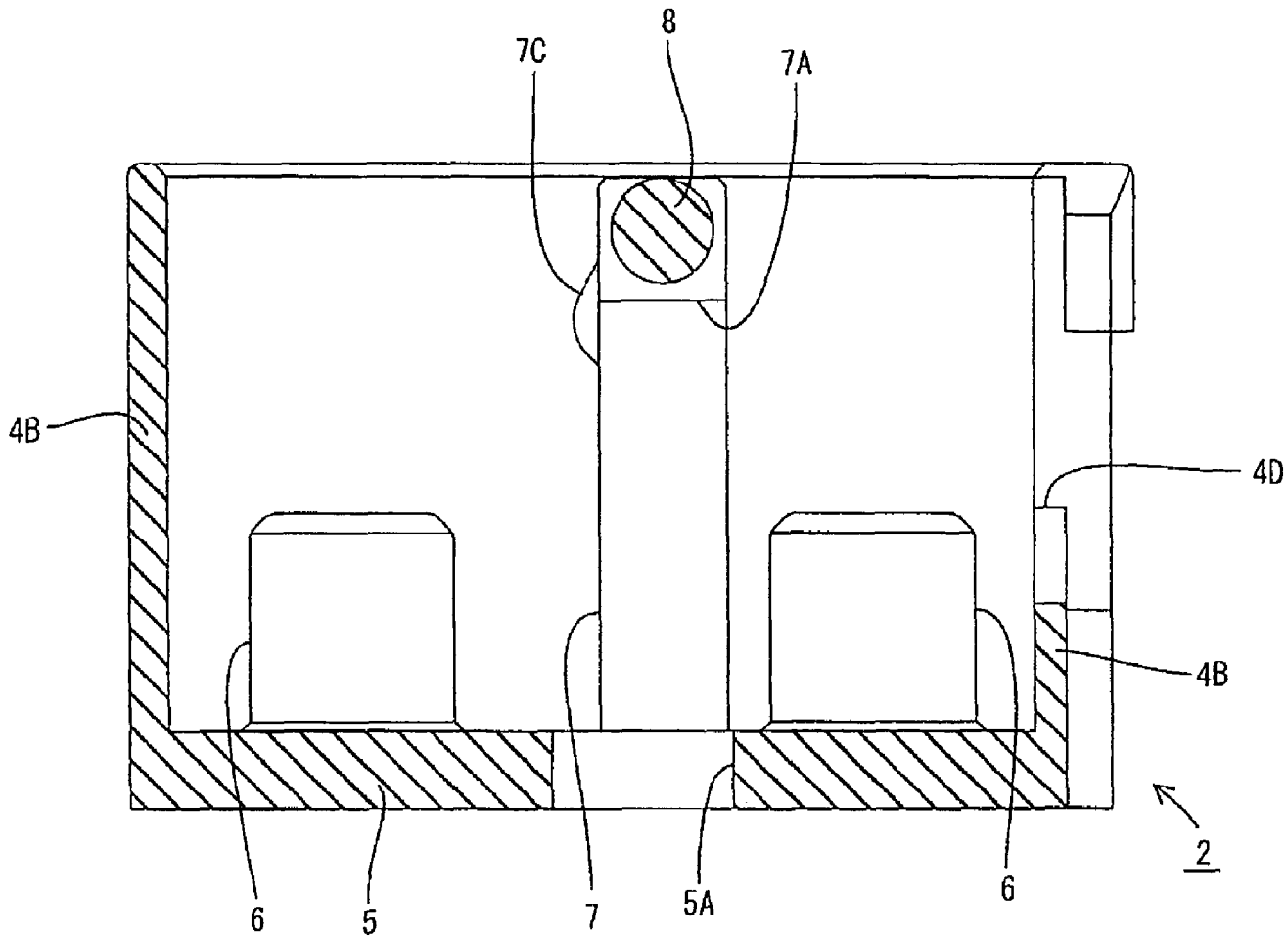
FIG. 9 is a section along IX-IX of FIG. 10.

As shown in FIG. 5, a closure 7 projects in and down from a ceiling wall 4C in the receptacle 4 between the two male terminal fittings 6 transversely arranged side by side at the upper stage. The closure 7 extends over substantially the entire length of the receptacle 4 in forward and backward directions FBD, and the back end thereof is coupled to the back wall 5. Guiding recesses 7B are formed at positions of the left and right surfaces of the closure 7 near the ceiling wall 4C and extend over substantially the entire length in forward and backward directions FBD, as shown in FIG. 10. Further, a semi-locking interacting protrusion 7C with an arcuate cross section is formed near a front of the surface of the closure 7 substantially opposite the notch 4D, as shown in FIG. 9.

A support 7A projects in and down at the front end of the closure 7 and has substantially the same width as the closure 7. A substantially cylindrical cam functioning portion 8 projects down and in from the bottom surface of the supporting projection 7A, and has an axis line that extends substantially vertically and normal to the connecting directions CD of the housings 1, 2. On the other hand, two guiding walls 9 project in from a bottom surface 4A to the back wall 5 in the receptacle 4, as shown in FIG. 5 or 10. The guiding walls 9 are arranged between the transversely adjacent male terminal fittings 6 at the lower stage, and the front ends thereof are more forward than the front ends of the male terminal fittings 6 with respect to forward and backward directions FBD.

The back wall 5 of the receptacle 4 has a mold removal hole 5A to mold the rear side of the closure 7 from the bottom surfaces of the guiding recesses 7B to the bottom end of the cam functioning portion 8. An internal mold removal space S is defined for the receptacle 4, and a mold pin of a molding die is inserted from behind between the supporting projection 7A, the cam function portion 8 and the mold removal hole 5A when the second housing 2 is molded.

Figure 12:
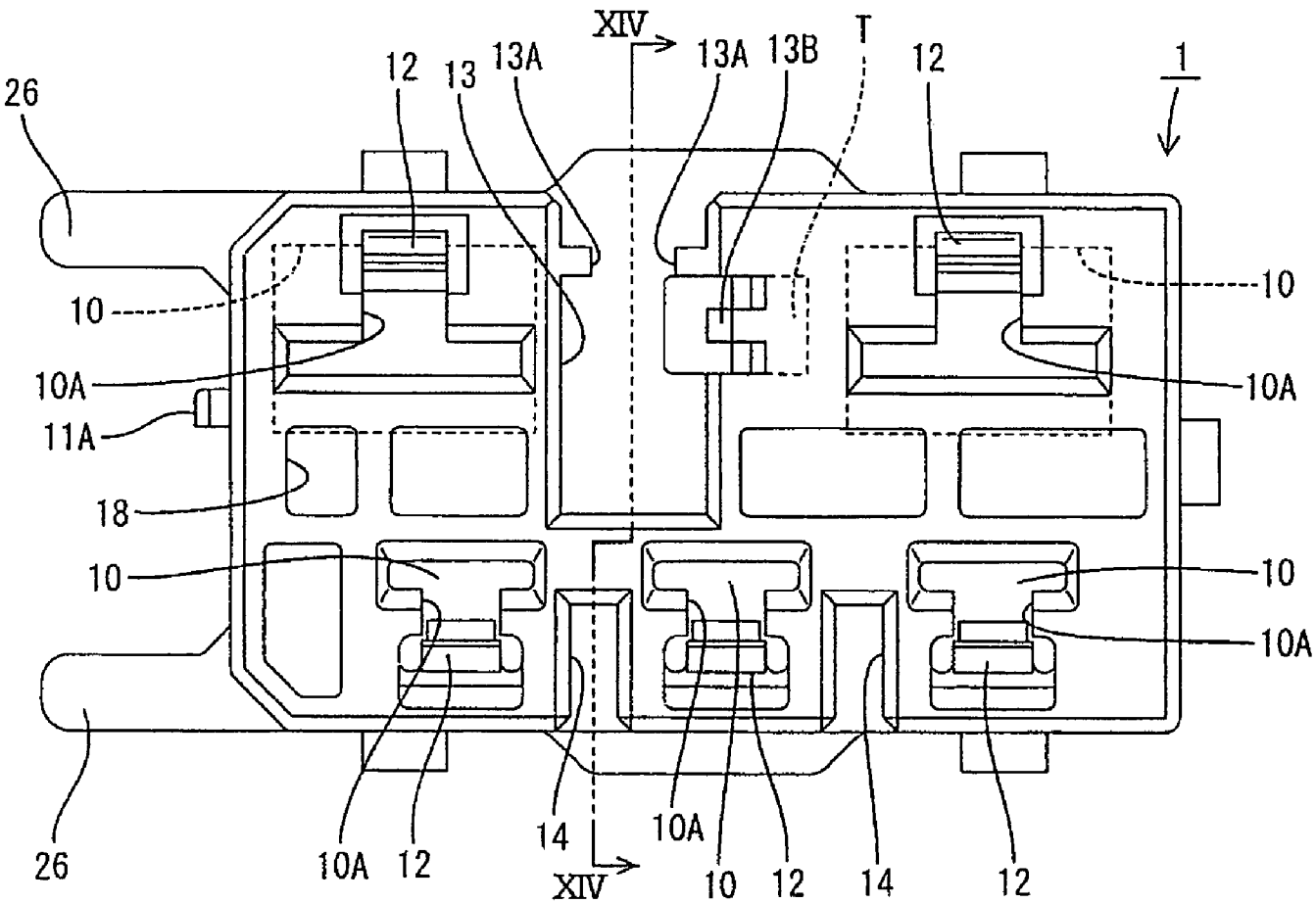
FIG. 12 is a front view of the first housing.
Figure 13:
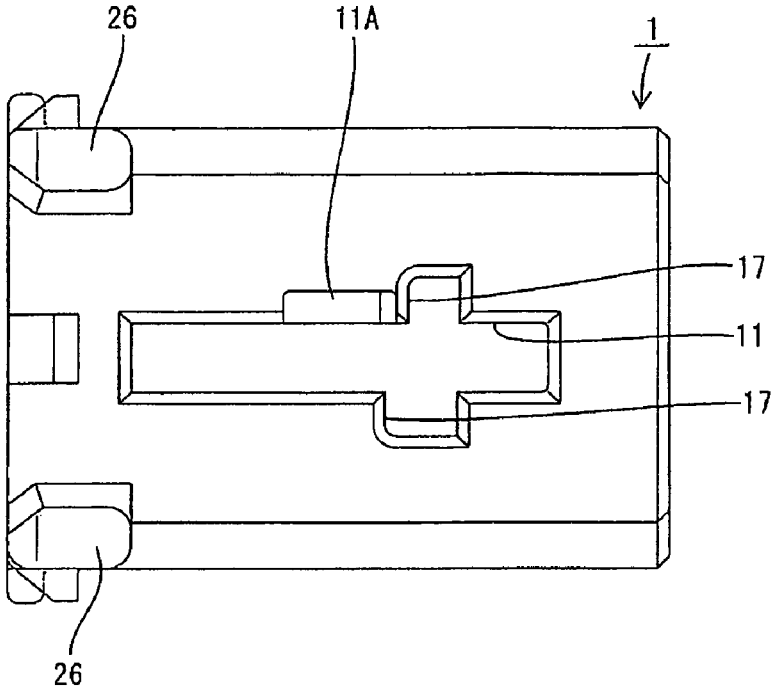
FIG. 13 is a left side view of the first housing.
Figure 14:
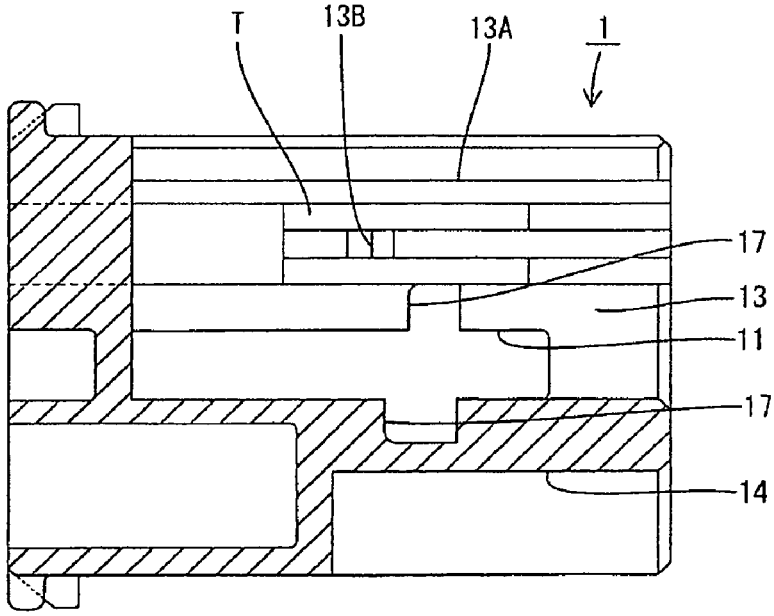
FIG. 14 is a section along XIV-XIV of FIG. 12.

The first housing 1 is molded, e.g. of a synthetic resin, to form a substantially rectangular block, as shown in FIG. 12, and can fit into the receptacle 4 of the second housing 1. Cavities 10 penetrate the first housing 1 in forward and backward directions FBD and a slider insertion hole 11 penetrates the first housing 1 in a direction substantially normal to the forward and backward directions FBD and in a moving direction MD that is substantially as shown in FIG. 13. The slider 3 is mountable into the slider insertion hole 11 laterally from the left of FIG. 12. Cavities 10 are arranged at positions corresponding to the male terminal fittings 6 upon connecting the two housings 1, 2, and female terminal fittings are insertable into the cavities 10 from behind and along forward and backward directions FBD, which are substantially parallel to the connecting directions CD of the housings 1, 2. A resiliently deformable lock 12 projects in from an inner wall of each cavity 10. The female terminal fitting is stopped at its front end position by a front wall 10A and is prevented from coming out backward by the engagement of the lock 12.

An escaping groove 13 extends from the front surface of the first housing 1 to the upper surface thereof, as shown in FIG. 12, and receives the closure 7 during the connection of the two housings 1, 2. Guides 14 are formed in the front and bottom surfaces of the first housing 1 and receive the respective guiding walls 9. Guiding projections 13A are formed on the opposite side walls of the escaping groove 13 at positions corresponding to the guiding recesses 7B of the closure 7 and extend over substantially the entire length in forward and backward directions FBD. The guides 13A engage the guiding recesses 7B with respect to vertical and transverse directions during the connection of the two housings 1, 2. The engagement of the guiding projections 13A and the guiding recesses 7B guide the connection of the two housings 1, 2 at an initial stage and prevent an upward opening movement of the ceiling wall 4C of the receptacle 4 during the connection. Thus, the two housings 1, 2 can be connected smoothly by the engagement of the guiding walls 9 and the guidable portions 14 during the connecting operation.

A semi-locking projection 13B is formed substantially along forward and backward directions FBD in the escaping groove 13 and projects arcuately in at a position corresponding to the semi-locking interacting portion 7C of the closure 7 during the connection of the two housings 1, 2. A deformation space T is formed at the rear side (right side in FIG. 12) of the semi-locking portion 13B and opens at the rear surface of the first housing 1. Thus, the semi-locking portion 13B is supported at both ends and is resiliently deformable into the deformation space T. Accordingly, the semi-locking projection 13B contacts the semi-locking interacting portion 7C during the connection of the two housings 1, 2 and is deformed. The semi-locking projection 13B then moves beyond the semi-locking interacting portion 7C and is restored resiliently to hold the two housings 1, 2 separably.

The slider insertion hole 11 penetrates a partition wall between adjacent upper and lower cavities 10 in FIG. 12 in a transverse direction. The slider 3 is mountable into the slider insertion hole 11 laterally from the left side of FIG. 12 and in a direction substantially normal to the connecting directions CD of the two housings 1, 2. The slider insertion hole 11 has a substantially rectangular shape that is long in forward and backward directions FBD, as shown in FIG. 13. The bottom surface of the slider insertion hole 11 is substantially flush with that of the escaping groove 13. The cam functioning portion 8 enters a part of the escaping groove 13, which is also part of the slider insertion hole 11, during the connection of the two housings 1, 2.

Retainer insertion holes 17 are formed in the inner upper and bottom surfaces of the slider insertion hole 11 and penetrate the first housing substantially in a transverse direction. The retainer insertion holes 17 cross the insides of the upper and lower cavities 10 to provide communication between the upper and lower cavities 10 and the slider insertion hole 11. With the female terminal fittings inserted to their front end positions and are stopped by the front walls 10A of the cavities 10. Simultaneously, the locks 12 engage locking holes in main portions of the female terminal fittings to hold the female terminal fittings so as not to come out, and the rear ends of the main portions of the female terminal fittings are located at positions substantially corresponding to the front edges of the retainer locking holes 17. Any female terminal fittings that are left insufficiently inserted will be behind the proper insertion position. Thus, the lock 12 will not engage the locking hole and the rear end of the main portion of the female terminal fitting faces the retainer insertion hole 17.

As shown in FIG. 12, bores are formed in the front surface of the first housing 1 at laterally spaced positions between the upper and lower cavities 10. The bore nearest the mounting side of the slider 3 (left side of FIG. 12) communicates with the slider insertion hole 11 and defines a locking hole 18 for partial locking of the slider 3, as described later. A partial locking interacting surface 11A is provided at the opening edge of the slider insertion hole 11 at a side where the slider 3 is mounted and projects out from this opening edge. Further, upper and lower protecting portions 26 are formed at the rear end of the right surface of the first housing 1 at the mounting side of the slider 3.

The slider 3 is in the form of a horizontal plate made e.g. of a synthetic resin and elongated in transverse direction. The slider is movable in the slider insertion hole 11 between a partial locking position 1P shown in FIGS. 1 and 2 and a full locking position 2P shown in FIGS. 3 and 4. An operating plate 19 is formed at one transverse end of a main body 23 and extends substantially normal to a mounting direction MD of the slider 3 so that the slider 3 can be pushed. Further, hooks 20 are formed at the front and rear ends of the operating plate 19 to pull the slider 3 out in a reverse direction.

The main body 23 is a substantially rectangular plate and a cam groove 24 is recessed in at least the upper surface thereof. The cam groove 24 is oblique both to the forward and backward directions FBD and the mounting direction MD, and is engageable with the cam functioning portion 8 during the connection of the two housings 1, 2. A part of the main body 23 before an entrance 24A of the cam groove 24 is cut out so that the entrance 24A has an open front end. A return preventing projection 24C is formed substantially normal to the longitudinal direction of the cam groove 24 at a part of the cam groove 24 before a back end 24B. The entrance 24A of the cam groove 24 is in the escaping groove 13 when the slider 3 is at the partial locking position 1P so that the cam functioning portion 8 can be received therein.

Figure 15:
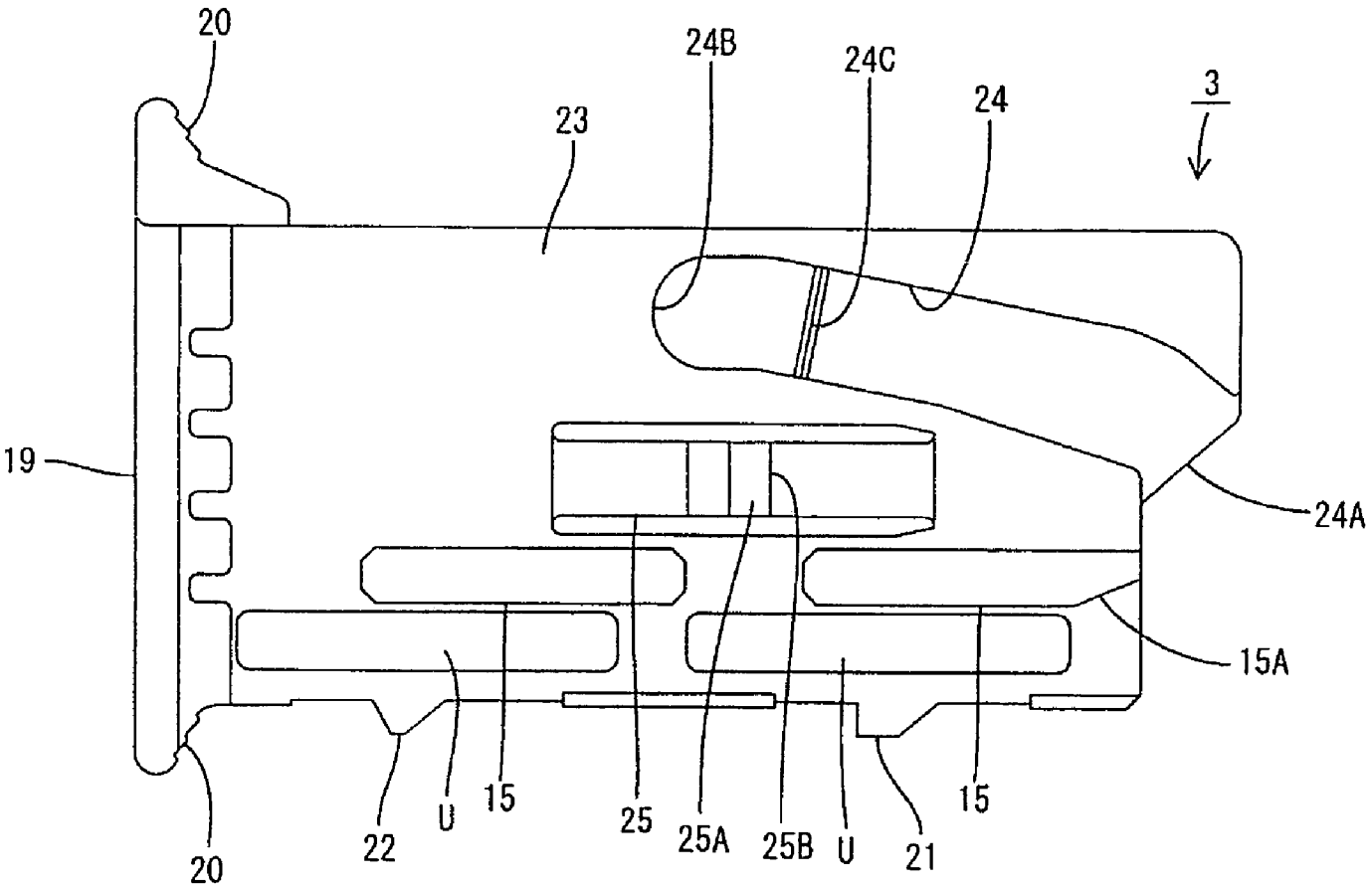
FIG. 15 is a plan view of the slider.

As shown in FIG. 15, a partial locking projection 21 and a full locking projection 22 are formed at transversely spaced positions on the front end surface of the main body 23. The left surface of the partial locking projection 21 is an upright surface substantially normal to the mounting direction MD of the slider 3 into the first housing 1 and the right surface thereof is inclined down to the right. On the other hand, the right surface of the full locking projection 22 is inclined down to the right and the left surface thereof is inclined down to the left. Rectangular deformation spaces U penetrate the main body 23 vertically behind both projections 21, 22 and are narrow and long in the transverse direction. The projections 21, 22 are supported at both ends and are resiliently deformable into the deformation spaces U.

Figure 16:
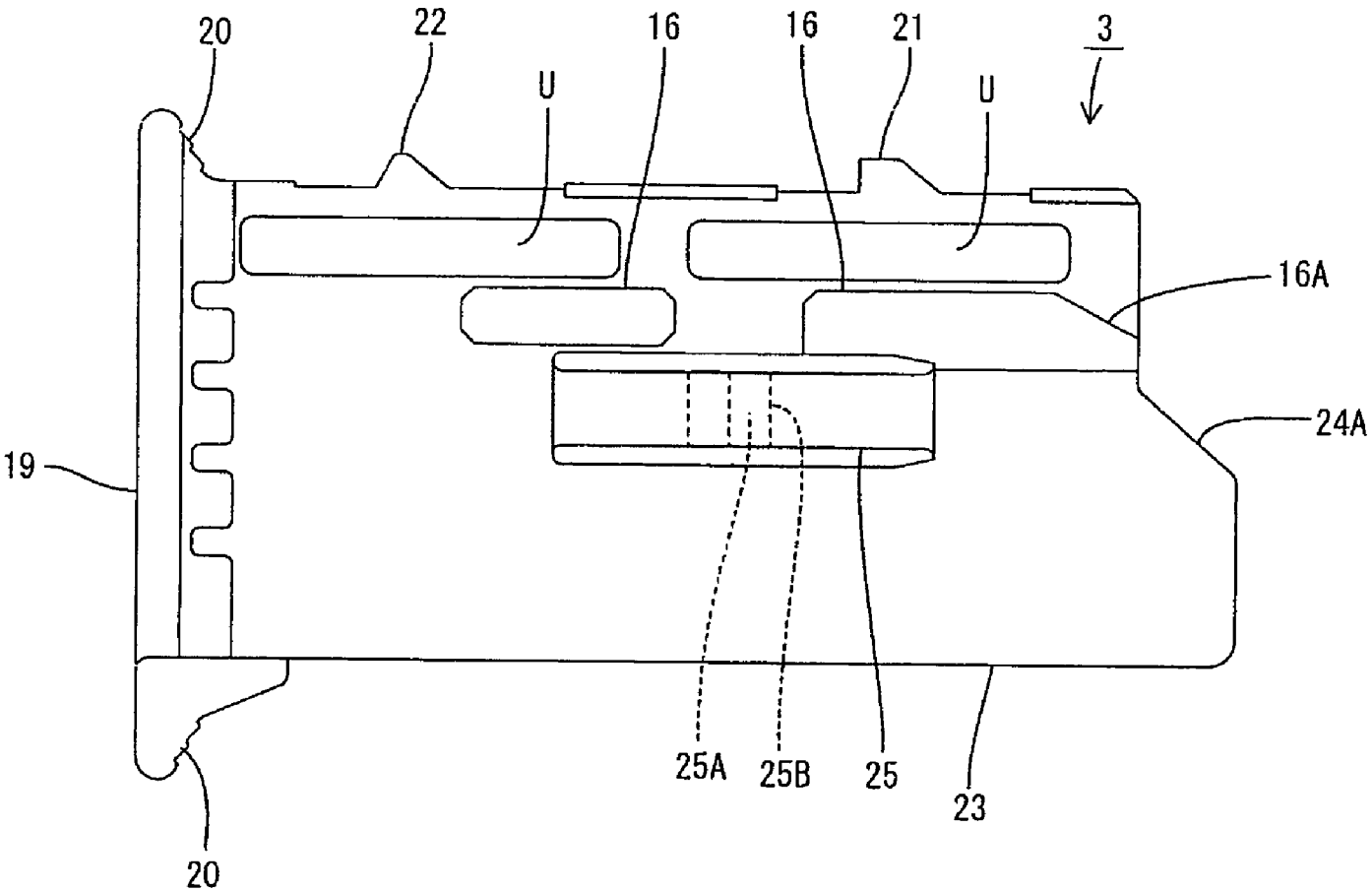
FIG. 16 is a bottom view of the slider.
Figure 17:
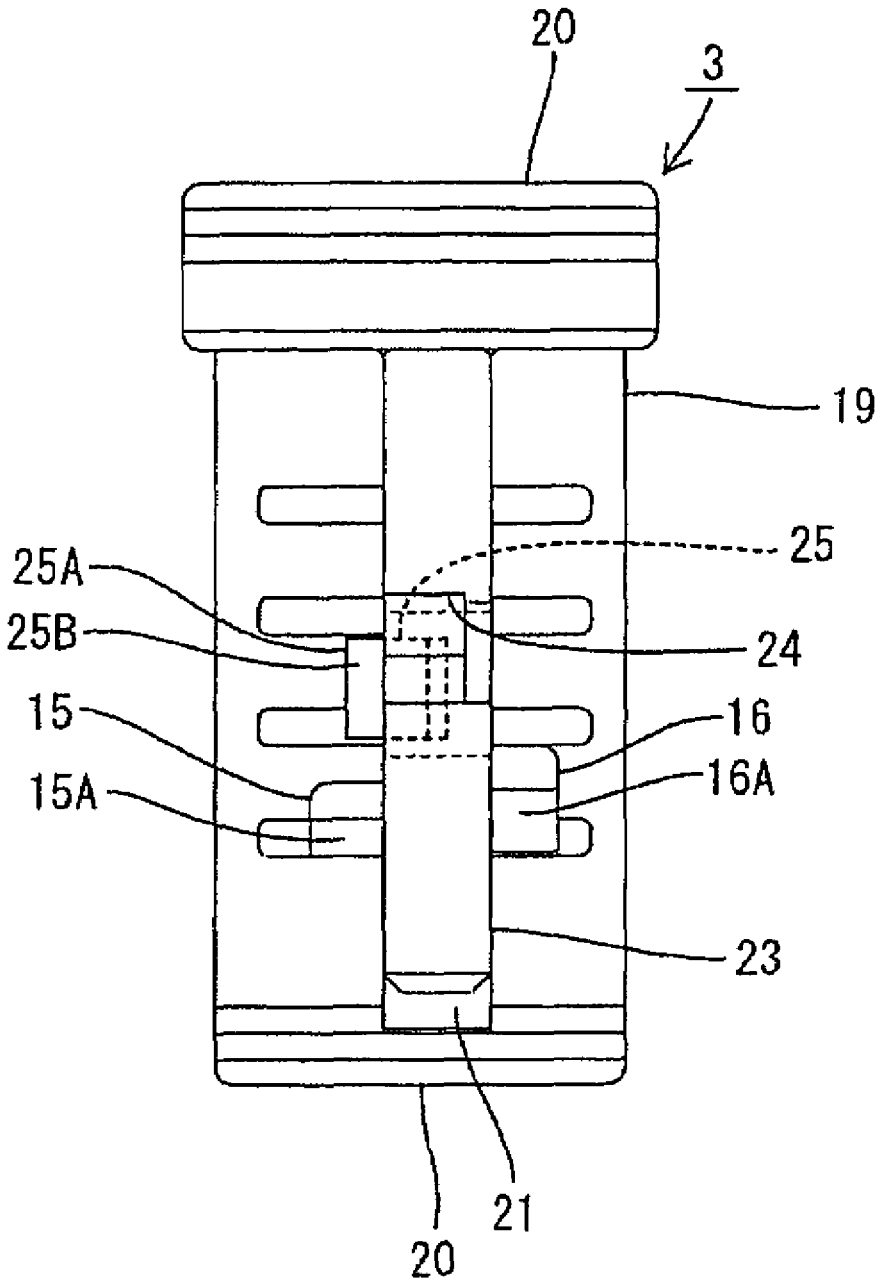
FIG. 17 is a right side view of the slider.
Figure 18:
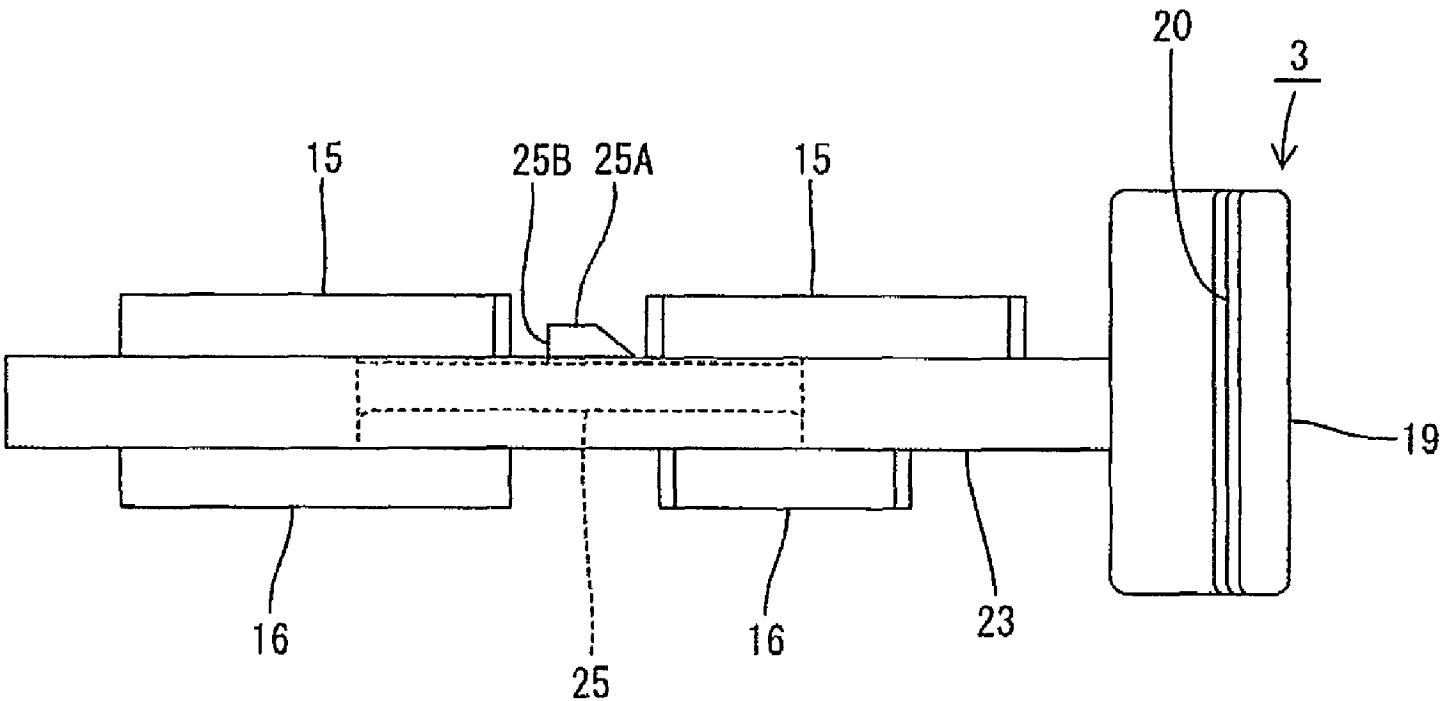
FIG. 18 is a rear view of the slider.

As shown in FIG. 15, two upper retainers 15 project up from the upper surface of the main body 23 at positions behind the deformation spaces U. The upper retainers 15 are narrow and long in the transverse direction and are arranged side by side in the transverse direction. An upper inclined surface 15A is formed at the right end of the front surface of the right upper retainer 15 and is oblique to the transverse direction. On the other hand, as shown in FIG. 16, two lower retainers 16 project down from the lower surface of the main body 23 at positions behind the deformation spaces U. The lower retainers 16 are narrow and long in the transverse direction and are arranged side by side in transverse direction. A lower inclined surface 16A is formed at the right end of the front surface of the right lower retainer 16 and extends oblique to the transverse direction.

As shown in FIG. 15, a forward-movement preventing portion 25 is defined by two slits that penetrate the main body 23 vertically. The slits are narrow and long in the transverse direction and are opposed to each other in forward and backward directions FBD in an intermediate part of the main body 23. The forward-movement preventing portion 25 is thin as compared to the main body 23, and hence can deform vertically. A forward-movement preventing projection 25A projects out and up at a transversely intermediate position of the upper surface of the forward-movement preventing portion 25. The upper end of the forward-movement preventing projection 25A is above the upper surface of the main body 23. The left surface of the forward-movement preventing projection 25A inclines down to the left. However, a locking surface 25B at the right side of the forward-movement preventing projection 25A is at a substantially right angle to the mounting direction MD of the slider 3 into the first housing 1. The locking surface 25B engages the partial locking interacting surface 11A when the slider 3 is at the partial locking position 1P to prevent the slider 3 from moving inadvertently to the full locking position 2P. The locking surface 25B slides in contact with the inner surface of the slider insertion hole 11 when the slider 3 is moved from the partial locking position 1P to the full locking position 2P, and causes the forward-movement preventing portion 25 to deform. However, the forward-movement preventing portion 25 restores resiliently in the mold removal space S, which is in the escaping groove 13, when the slider 3 reaches the full locking position 2P.

The female terminal fittings are inserted into the cavities 10 of the first housing 1 from behind before the slider 3 is mounted into the first housing 1. The locks 12 engage the locking holes to hold the properly inserted female terminal fittings in the cavities 10. The rear end of the main portion of any insufficiently inserted female terminal fitting is located in the retainer insertion hole 17. The slider 3 is inserted into the slider insertion hole 11 in the mounting direction MD after all the female terminal fittings are inserted, and the operating portion 19 then is pushed by a finger. At this time, the partial locking projection 21 of the slider 3 contacts the front opening edge of the slider insertion hole 11, and deforms laterally to the right while remaining resiliently deformed as the slider 3 is inserted. The partial locking projection 21 is restored resiliently in the locking hole 18 when the slider 3 reaches the partial locking position 1P. At this time, the locking surface 25B of the forward-movement preventing projection 25A of the forward-movement preventing portion 25 contacts the partial locking interacting surface 11A to prevent the slider 3 from inadvertently moving to the full locking position 2P. Further, the upright left surface of the partial locking projection 21 engages the left edge of the locking hole 18 so that the slider 3 cannot come out laterally (leftward).

The operating portion 19 can be pushed by hand to move the slider 3 from the partial locking position 1P to the full locking position 2P. The forward-movement preventing portion 25 is deformed resiliently down and in by this pushing operation. Thus, the locking surface 25B and the partial locking interacting surface 11A disengage from each other to permit movement of the slider 3 to the full locking position 2P. The forward-movement preventing portion 25 deforms laterally to the right while the slider 3 is moving to the full locking position 2P, and the full locking projection 22 contacts the side of the opening edge of the slider insertion hole 11 slightly before the full locking position 2P. The forward-movement preventing portion 25 deforms backward as the slider 3 is inserted, and moves laterally while being kept resiliently deformed. The forward-movement preventing portion 25 then is restored resiliently upon reaching the locking hole 18. At this time, the slider 3 is held in a semi-locked state (can be pulled back) at the left side by the engagement of the left slanted surface of the full locking projection 22 and the left edge of the locking hole 18. Simultaneously, the forward-movement preventing portion 25 enters the mold removal space S and is restored resiliently.

In the process of mounting the slider 3, the upper and lower retainers 15 and 16 project into the upper and lower cavities 10 through the retainer insertion holes 17, and move laterally in the cavities 10 as the slider 3 is moved. The upper inclined surface 15A contacts the rear end of the main portion of any insufficiently inserted female terminal fitting in the upper stage cavities 10 and pushes the rear end of the main portion. Similarly the lower inclined surface 16A pushes any insufficiently inserted female terminal fittings in the lower stage cavities 10. Thus, any insufficiently inserted female terminal fittings are pushed forward to the proper insertion position and are held by the respective lock 12 so as not to come out. In this way, the insertion of the female terminal fittings into the first housing 1 is completed.

The first housing 1 then is transported to a site for assembling with the second housing 2. At this time, the slider 3 is in the slider insertion hole 17 at the full locking position 2P. However, the hooks 20 of the slider 3 are gripped manually and the slider 3 and pulled back temporarily to the partial locking position 1P. As a result, the full locking projection 22 is deformed back to cancel the semi-locked state of the left surface of the full locking projection 22 and the left edge of the locking hole 18. Additionally, the forward-movement preventing portion 25 contacts the bottom end of the left surface of the escaping groove 13 to be deformed in and down. In this way, the slider 3 is permitted to move to the partial locking position 1P shown in FIG. 1. The forward-movement preventing portion 25 is kept deformed while the slider 3 is moving to partial locking position 1P. The forward-movement preventing portion 25 is restored resiliently when the slider 3 reaches the partial locking position 1P. At this time, the upright left surface of the partial locking projection 21 engages the left edge of the locking hole 18 to prevent the slider 3 from coming out laterally. With the slider 3 located at the partial locking position 1P, the entrance 24A of the cam groove 24 is in the escaping groove 13 to wait on standby for engagement with the cam function portion 8.

The first housing 1 is fit lightly into the receptacle 4. Thus, the cam functioning portion 8 moves into the entrance 24A of the cam groove 24 and backward along the escaping groove 13. At the start of the connection of the two housings 1, 2, the guiding projections 13A are fit in the guiding recesses 7B to guide the connecting operation. The guiding walls 9 then are fit into the guidable portions 14 so that a smoother connecting operation can be performed. The semi-locking portions 13B of the second housing 2 move over the semi-locking interacting portions 7C of the first housing 1 to prevent the second housing 2 from inadvertently coming out of the first housing 1. The operating portion 19 of the slider 3 then is pushed from the left to displace the slider 3 along the mounting direction MD and into the first housing 1. Movement of the slider 3 pulls the first housing 1 toward the second housing 2 by the cam action resulting from the engagement of the cam groove 24 and the cam functioning portion 8. At this time, the cam functioning portion 8 receives a large load from the cam groove 24, and pushes the closure 7 in an effort to escape from the load. These forces can urge the ceiling wall 4C of the receptacle 4 up out in some cases. However, the guiding projections 13A engage the respective guiding recesses 7B and prevent the ceiling wall 4C of the receptacle 4 from moving up or out. As a result, the cam groove 24 and the cam functioning portion 8 can be kept engaged. The cam functioning portion 8 moves over the return preventing projection 24C before the back end 24B of the cam groove 24 and moves to the back end 24B. The housings 1, 2 are connected properly when the slider 3 reaches the full locking position 2P, and the male terminal fittings 6 connect electrically with the female terminal fittings. At this time, the full locking projection 22 of the slider 3 engages the locking hole 18 to hold the slider 3 at the full locking position 2P. The cam action resulting from the engagement of the cam groove 24 and the cam functioning portion 8 locks the two housings 1, 2 in their properly connected state when the slider 3 is held at the full locking position 2P.

The operating portion 19 and the hooks 20 of the slider 3 are exposed to the outside of the receptacle 4 when the two housings 1, 2 are connected properly. However, the interference of external matter is hindered by the protecting portions 26 in the vicinity of the operating portion 19 and the hooks 20. The engaged parts in the escaping groove 13 of the cam groove 24 and the cam functioning portion are concealed by the receptacle 4.

The housings 1 and 2 can be separated by gripping the hooks 20 and pulling the slider 3 out laterally to the left to deform the full locking projection 22. The first housing 1 then starts separating from the second housing 2 due to the cam action resulting from the engagement of the cam groove 24 and the cam functioning portion 8.

As described above, the forward-movement preventing portion 25 of the slider 3 is deformed during the connecting operation, but is restored resiliently in the mold removal space S upon proper connection of the two housings 1, 2. Thus, a mold removal space S is utilized efficiently and the connector can be miniaturized by omitting a special space for the resilient restoration. Further, the guiding projections 13A of the first housing 1 engage the guiding recesses 7B of the receptacle 4 during connection of the housings 1, 2 to prevent the receptacle 4 from opening. Thus, the cam functioning portion 8 and the cam grooves 24 can be kept engaged. Further, the guiding projections 13A of the first housing 1 engaged the guiding recesses 7B of the receptacle 4 from the start of the connecting operation to the proper connection of the two housings 1, 2. Therefore, a connection guiding function is exhibited in addition to the function of preventing the opening of the receptacle 4.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The partial locking interacting surface projects to left from the outer left surface of the first housing in the foregoing embodiment. However, the position of the partial locking interacting surface does not matter provided that it conforms to a connection stroke of the slider. For example, the partial locking interacting surface may be in the slider insertion hole.

The forward-movement preventing portion is resiliently deformable along a vertical direction in the foregoing embodiment. However, the deforming direction is not limited to vertical direction, and the forward-movement preventing portion may be deformable in forward and backward directions.

The slider insertion hole is substantially in the vertical center (in the partition wall between the upper and lower cavities) in the foregoing embodiment. However, the slider insertion hole may be displaced either up or down according to the present invention.

The slider is substantially in the form of a plate for miniaturization along vertical direction in the foregoing embodiment. However, the slider may be U-shaped by connecting ends of two plates by an operable portion.

The first housing has the slider insertion hole and the second housing has the follower pin in the foregoing embodiment. However, the slider insertion hole and the follower pin may be reversed.

The above-described movable member is a slider, but it can be any movable member displaying a cam action other than a slider, such as a rotatable lever or the like.

Figure 19:
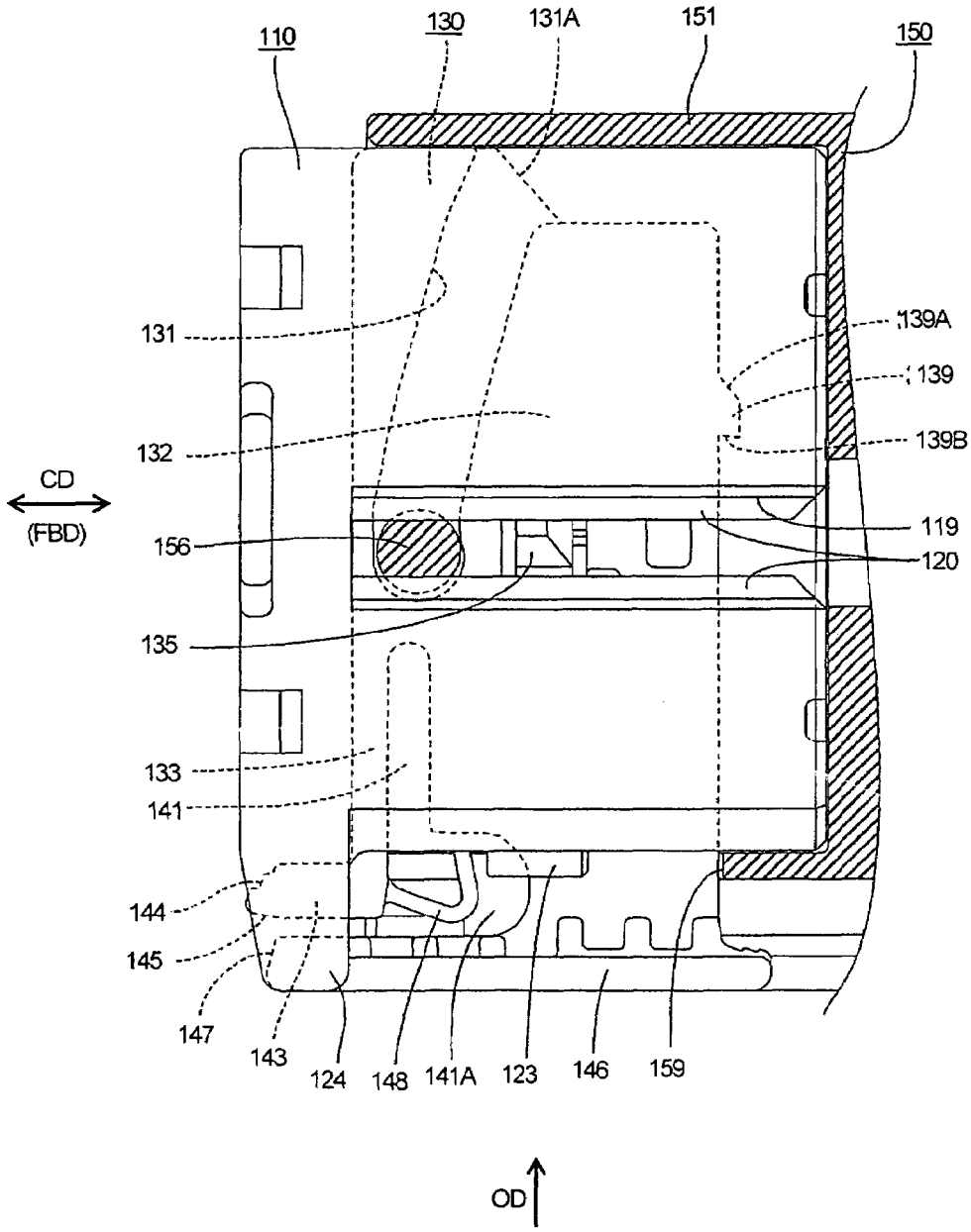
FIG. 19 is a plan view in section of a connector according to a second embodiment of the invention.

A second embodiment of the invention is described with reference to FIGS. 19 to 32. As shown in FIG. 19, a connector of this embodiment is provided with a female housing 110, a male housing 150, and a slider 130 operated to connect and separate the two housings 110, 150 or to assist their connection and/or separation. The slider 130 is inserted into and withdrawn from the female housing 110 in directions substantially normal to connecting and separating directions CD of the two housings 110, 150.

Figure 20:
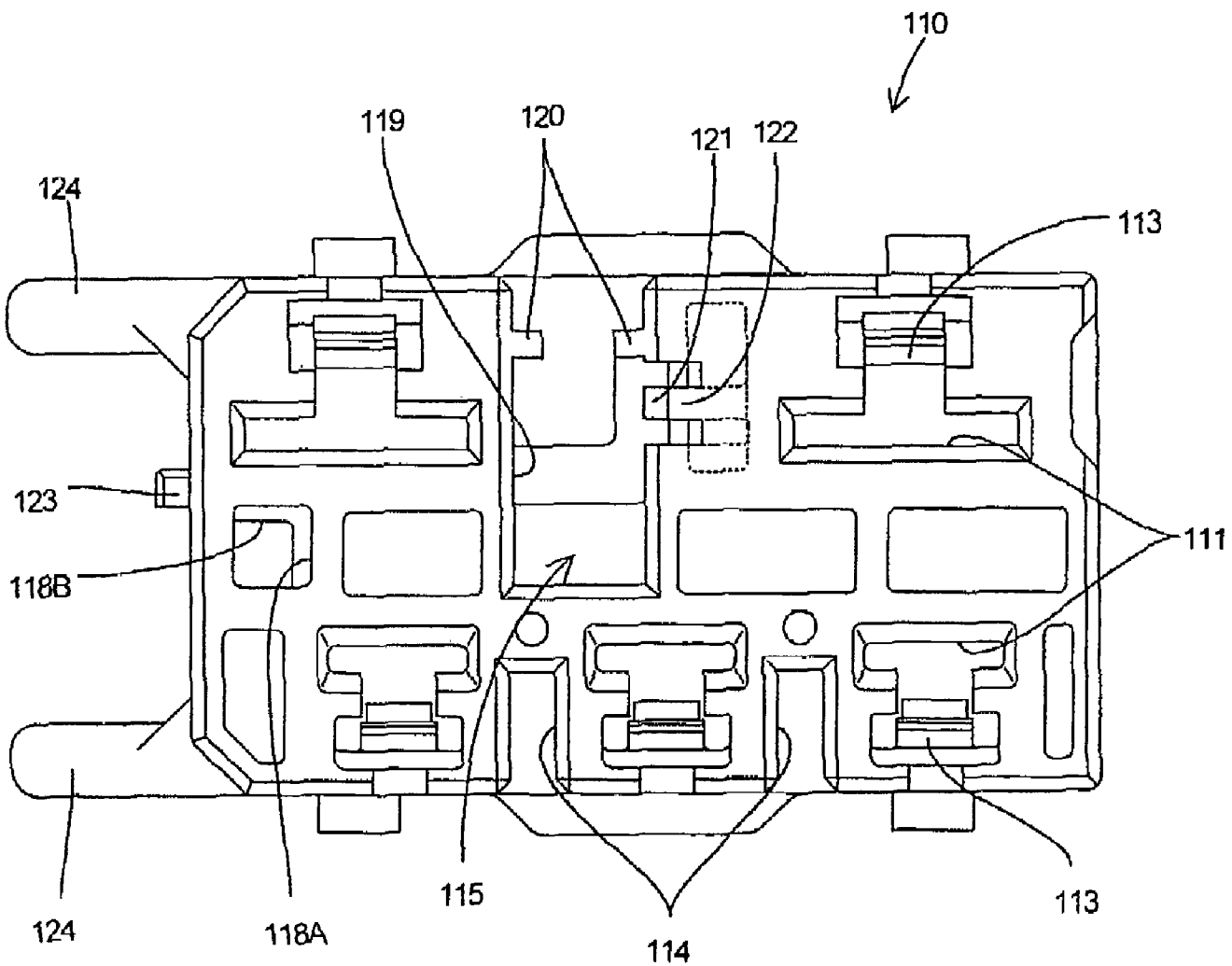
FIG. 20 is a front view of a female housing.
Figure 21:
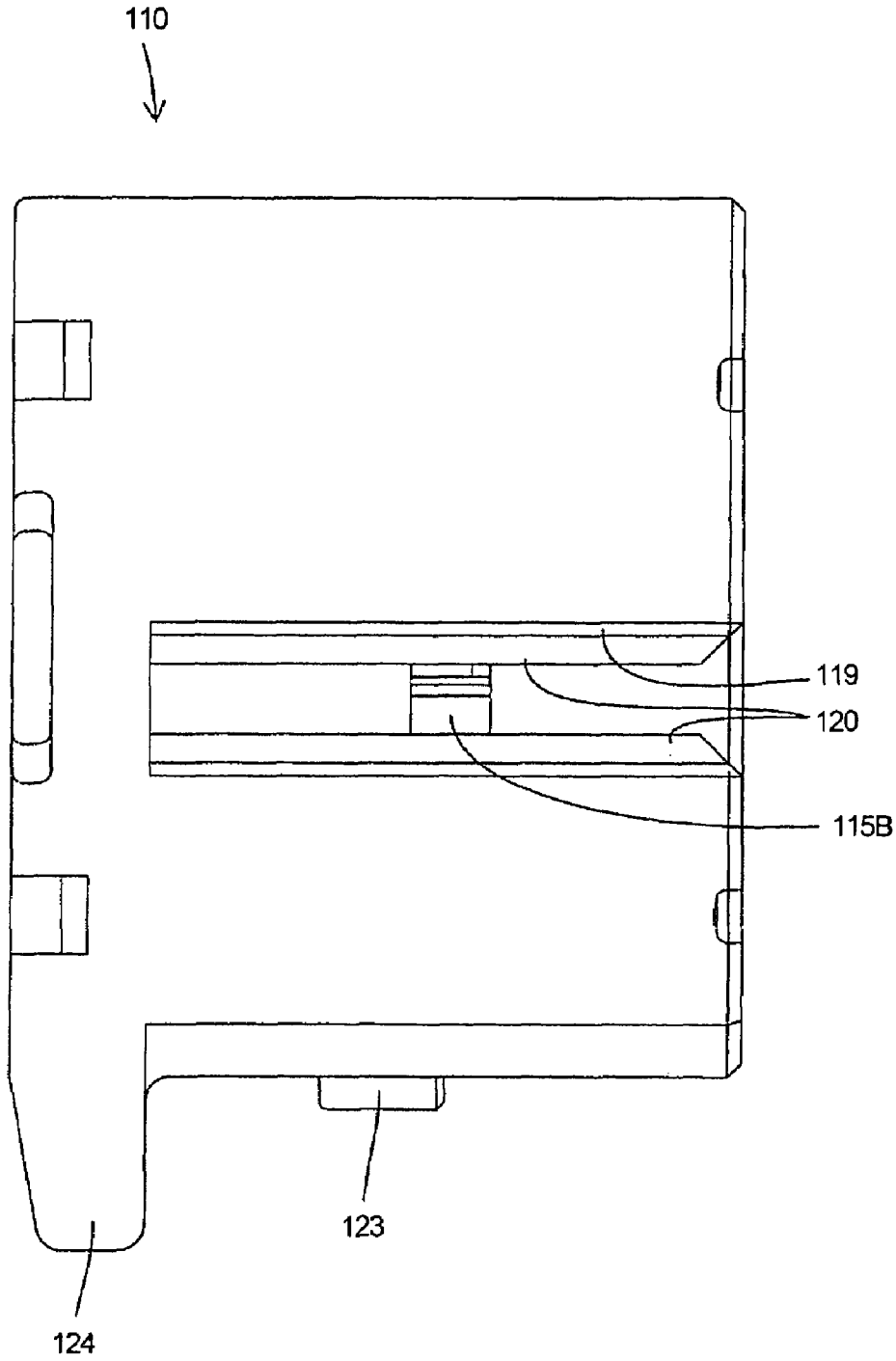
FIG. 21 is a plan view of the female housing.
Figure 22:
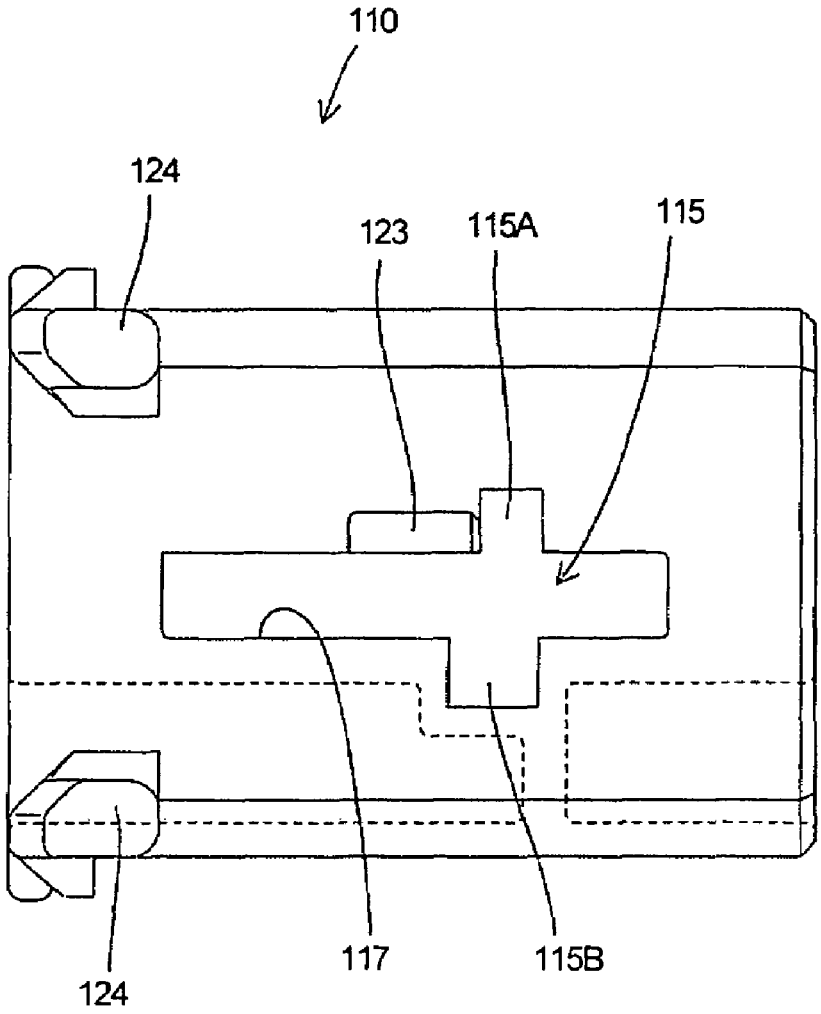
FIG. 22 is a side view of the female housing when viewed from left.
Figure 23:
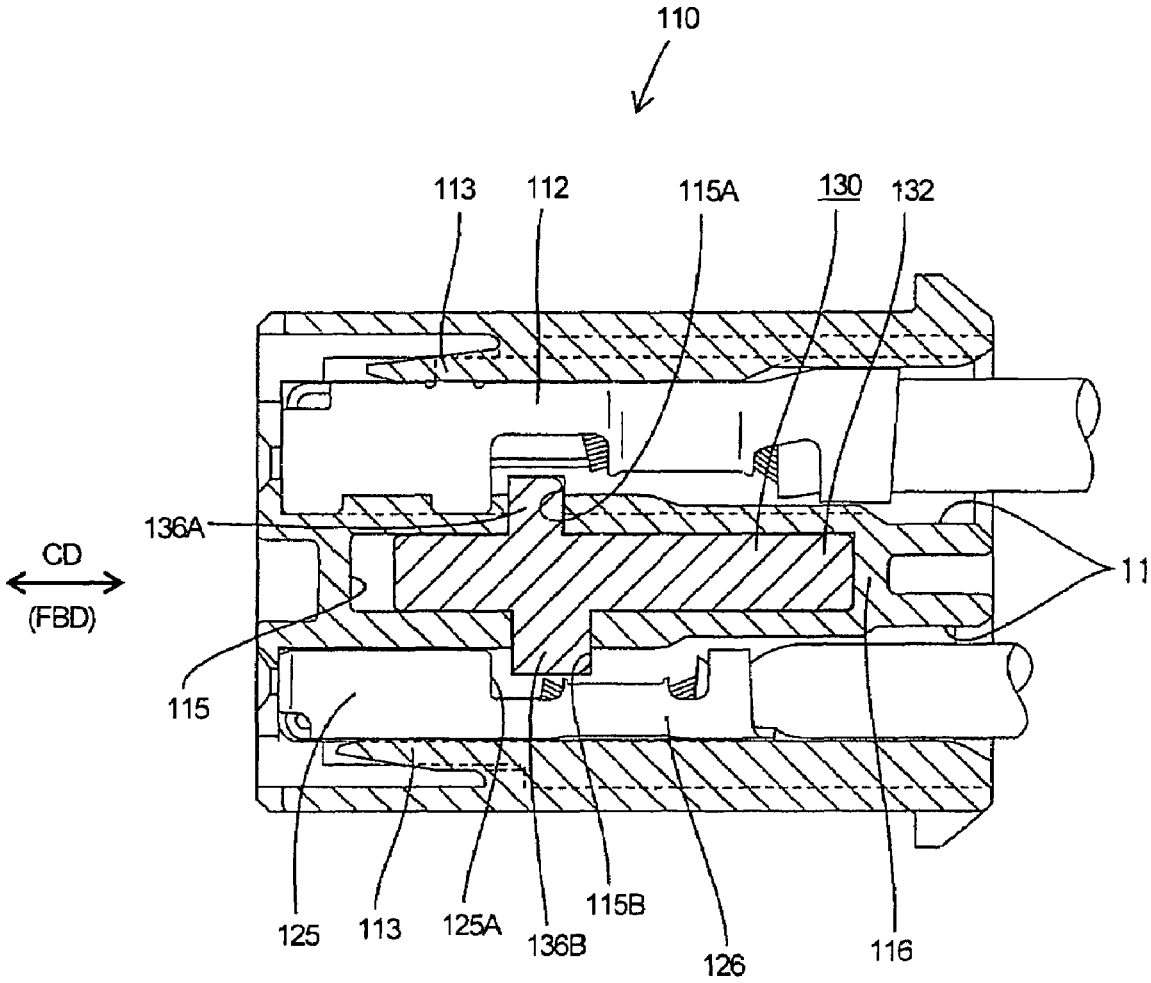
FIG. 23 is a side view in section of the female housing having female terminal fittings inserted therein.

As shown in FIGS. 20 to 22, the female housing 110 is, as a whole, in the form of a wide block. As shown in FIG. 20, cavities 111 are formed at upper and lower stages in the female housing 110. More particularly, two cavities 111 are formed substantially side by side at the upper stage and three cavities 111 are formed substantially side by side at the lower stage. The terminal fittings in cavities 111 at different stages have different configurations (e.g. shapes and/or dimensions). As shown in FIG. 23, each cavity 111 is long in forward and backward directions FBD and a female terminal fitting 112 is inserted therein from behind and along an inserting direction ID. Each cavity 111 at the upper stage has a lock 113 that cantilevers forward along the upper wall. Each cavity 111 at the lower stage has a lock 113 that cantilevers forward along the bottom wall. The locks 113 are resiliently deformable vertically in a direction intersecting the inserting direction ID. Vertical grooves 114 extend in forward and backward directions FBD between the cavities 111 at the lower stage (see FIGS. 20 and 24) and open in the front and bottom surfaces of the female housing 110.

The female housing 110 has a slider accommodating space 115 for receiving the slider 130. As shown in FIG. 23, the slider accommodating space 115 is formed in a partition wall 116 partitioning the upper and lower cavities 111 and has a substantially flat shape. This slider accommodating space 15 includes an upper-stage communicating portion 115A communicating with the upper cavities 111 and a lower-stage communicating portion 115B communicating with the lower cavities 111. The front edges of the upper and lower-stage communicating portions 115A, 15B are aligned substantially vertically.

Figure 25:
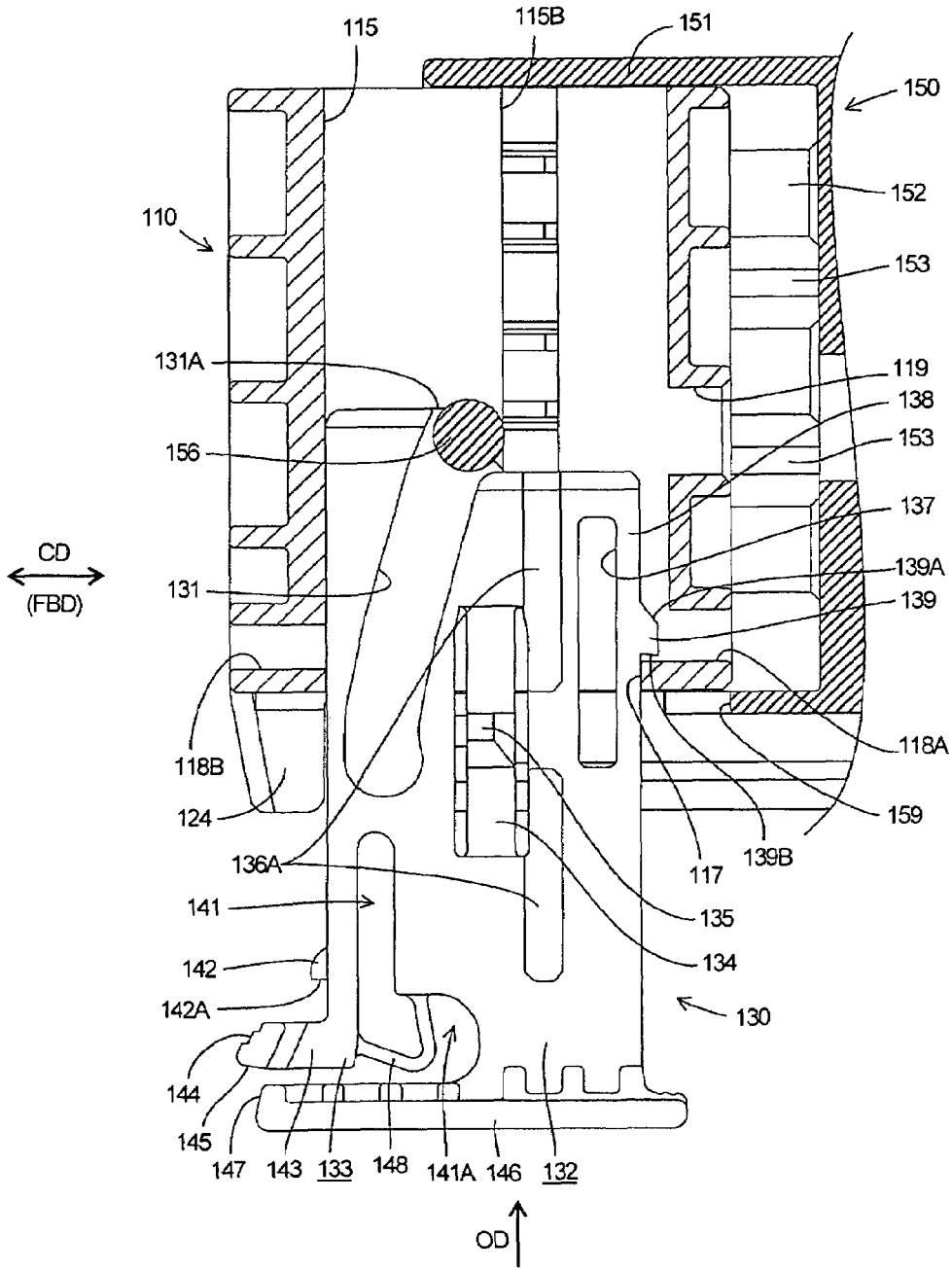
FIG. 25 is a plan view in section of the connector partly locked.

As shown in FIG. 25, this slider accommodating space 115 penetrates the female housing 110 transversely in a direction intersecting the connecting direction CD and opens at the left and right surfaces of the female housing 110. The slider 130 is movable in the operating direction OD intersecting the connecting direction CD in the slider accommodating space 115. A slider entrance 117 is defined in the left surface, and the slider 130 is inserted into and withdrawn from the slider accommodating space 115 through the slider entrance 117.

Front and rear communicating portions 118A and 118B respectively open in the front and rear surfaces of the female housing 110 near an end of the slider accommodating space 115 where the slider entrance 117 is located.

As shown in FIGS. 20 and 21, the female housing 110 has a cam-pin introducing path 119 formed by a recess in a part partitioning the adjacent left and right cavities 111 at the upper stage from outside. The cam-pin introducing path 119 is open in the front and upper surfaces of the female housing 110 and communicates with the slider accommodating space 115 (see FIG. 24). The cam-pin introducing path 119 is long in forward and backward directions FBD and extends back from the front edge of the female housing 110. The cross-sectional shape of the cam-pin introducing path 119 along a direction intersecting with forward and backward directions FBD is substantially rectangular and slightly longer in the vertical direction. Two opposed bulges 120 extend in forward and backward directions FBD on the side surfaces of the cam-pin introducing path 119.

Figure 24:
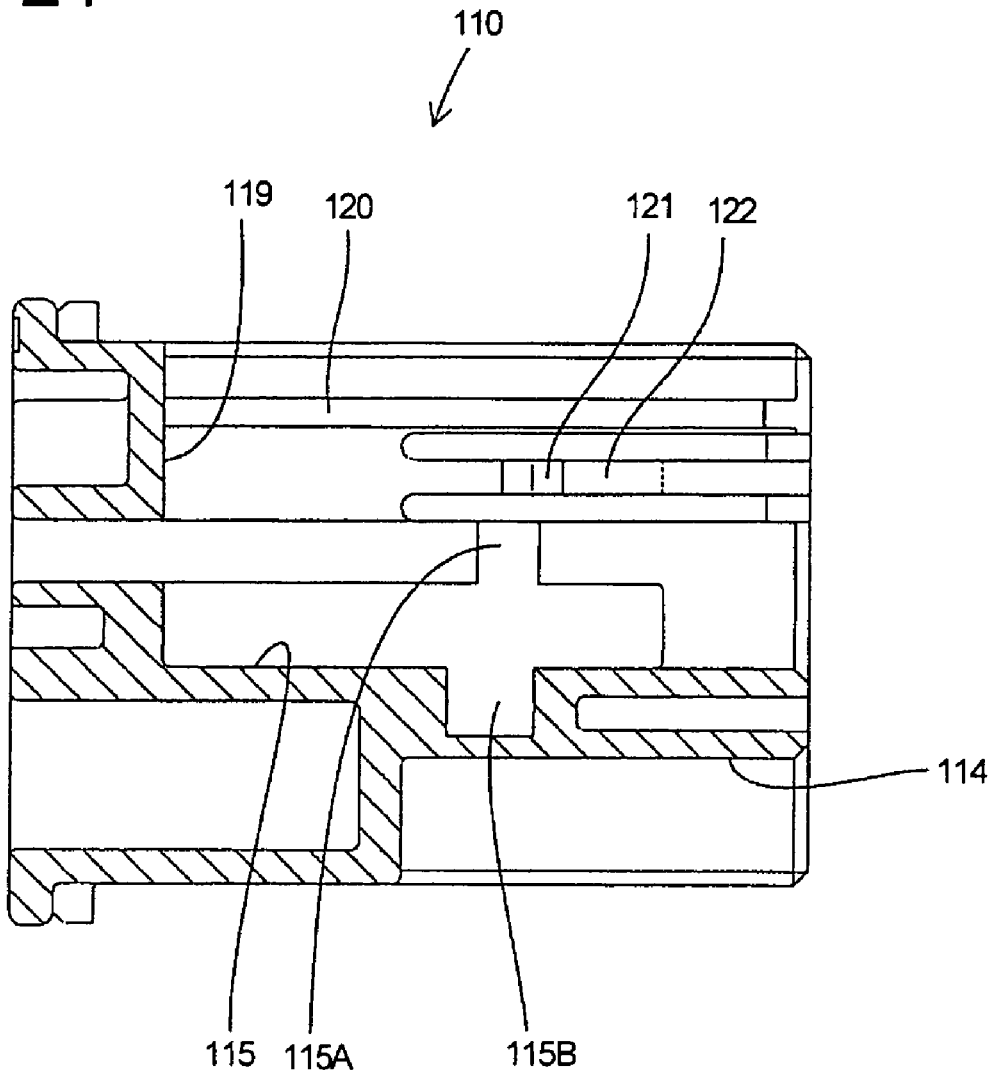
FIG. 24 is a side view in section of the female housing.

As shown in FIGS. 20 and 24, a mountain 121 projects below the right bulge 120 and has a peak that reaches substantially the same position as the position of the right surface of the cam-pin introducing path 119. The mountain 121 is on a resiliently deformable beam 122 supported at both ends and resiliently deformable along the transverse direction. The resiliently deformable portion 122 deforms to the left when the mountain 121 is pushed to the left. A curved projection 157 of the male housing 150 approaches the mountain 121 when a cam pin 156 of the male housing 150 is fit into the cam-pin introducing path 119 of the female housing 110 to bring the housings 110, 150 closer. The curved projection 157 pushes the mountain 121 laterally to the left when the housings 110, 150 are brought still closer. The cam pin 156 reaches an entrance 131A of a cam groove 131 when the curved projection 157 beyond the mountain 121 and an operator can feel the arrival of the cam pin 156 at the entrance 131A of the cam groove 131.

A temporary contact 123 projects laterally from the surface of the female housing 110 where the slider entrance 117 is formed for preventing the slider 130 from being pushed when the slider 130 is at a partial locking position. As shown in FIG. 22, the temporary contact 123 is a rectangular parallelepiped that is long in forward and backward directions FBD and is disposed along the upper edge of the slider entrance 117.

Upper and lower protections 124 project at the rear end of the left surface of the female housing 110.

The female terminal fittings 112 are long and narrow in forward and backward directions FBD, as shown in FIG. 23. A rectangular tubular terminal connecting portion 125 is formed at the front of each female terminal fitting 112 and a locking hole (not shown) is formed in one side wall of the terminal connecting portion 125. An engaging edge 125A is defined at the rear of the terminal connecting portion 125. A wire connecting portion 126 is formed at the rear of each female terminal fitting 112 and is configured to be connected crimped, bent or folded into electrical connection with an end of a wire. Each female terminal fitting 112 is inserted in the inserting direction ID into the cavity 111 so that the locking hole is opposed to the lock 113 of the cavity 111. The lock 113 engages the locking hole when the female terminal fitting 112 is inserted to a proper position and retains the female terminal fitting 112 in the female housing 110. Additionally, the engaging edge 125A of the terminal connecting portion 125 aligns with the front of the respective upper or lower-stage communicating portion 115A, 115B of the slider accommodating space 115. If the female terminal fitting 112 is inserted insufficiently, the lock 113 cannot engage the locking hole and the engaging portion 125A of the terminal connecting portion 125 is in the upper-stage or lower-stage communicating portion 115A or 115B.

Figure 26:
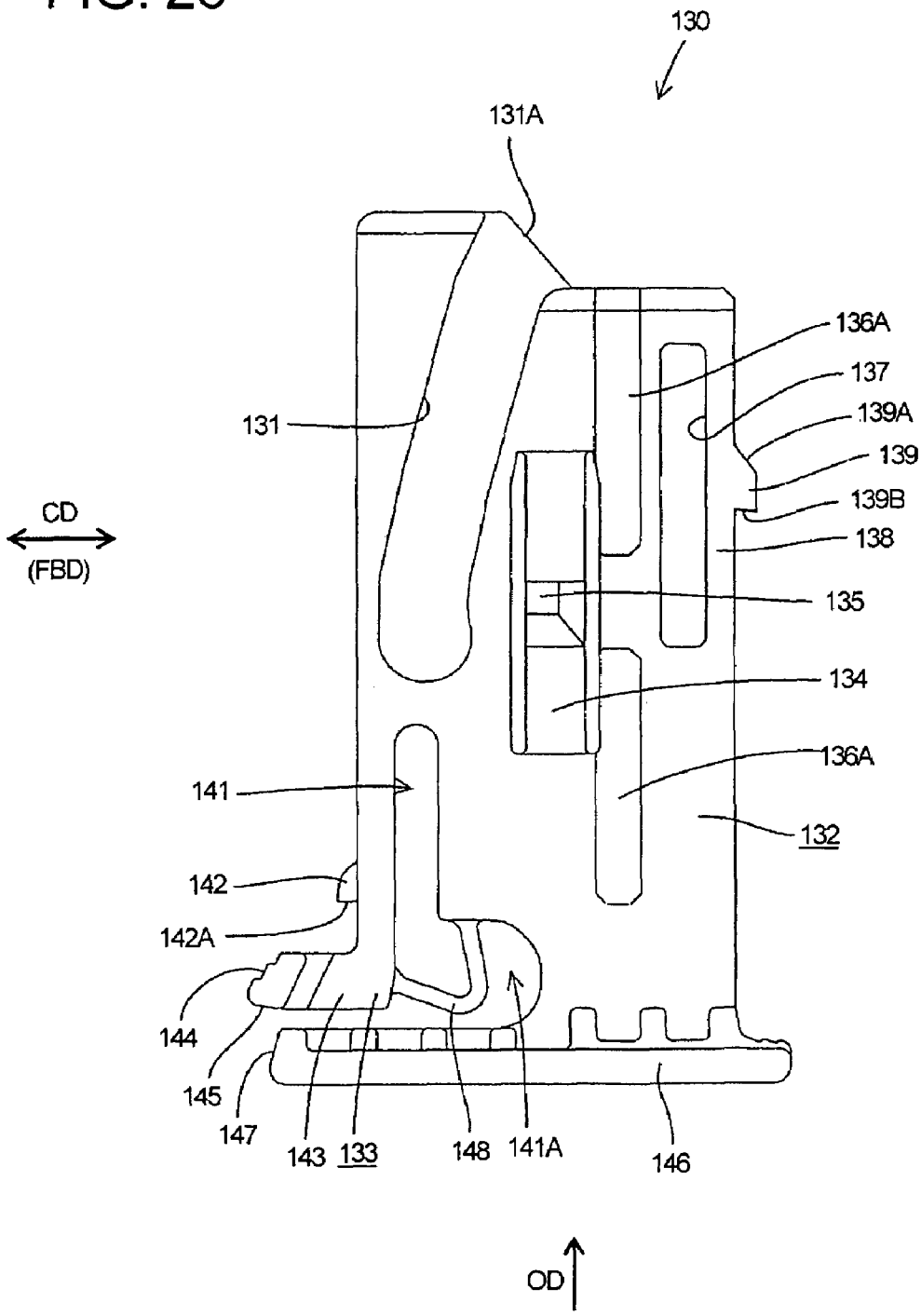
FIG. 26 is a top view of a slider.
Figure 27:
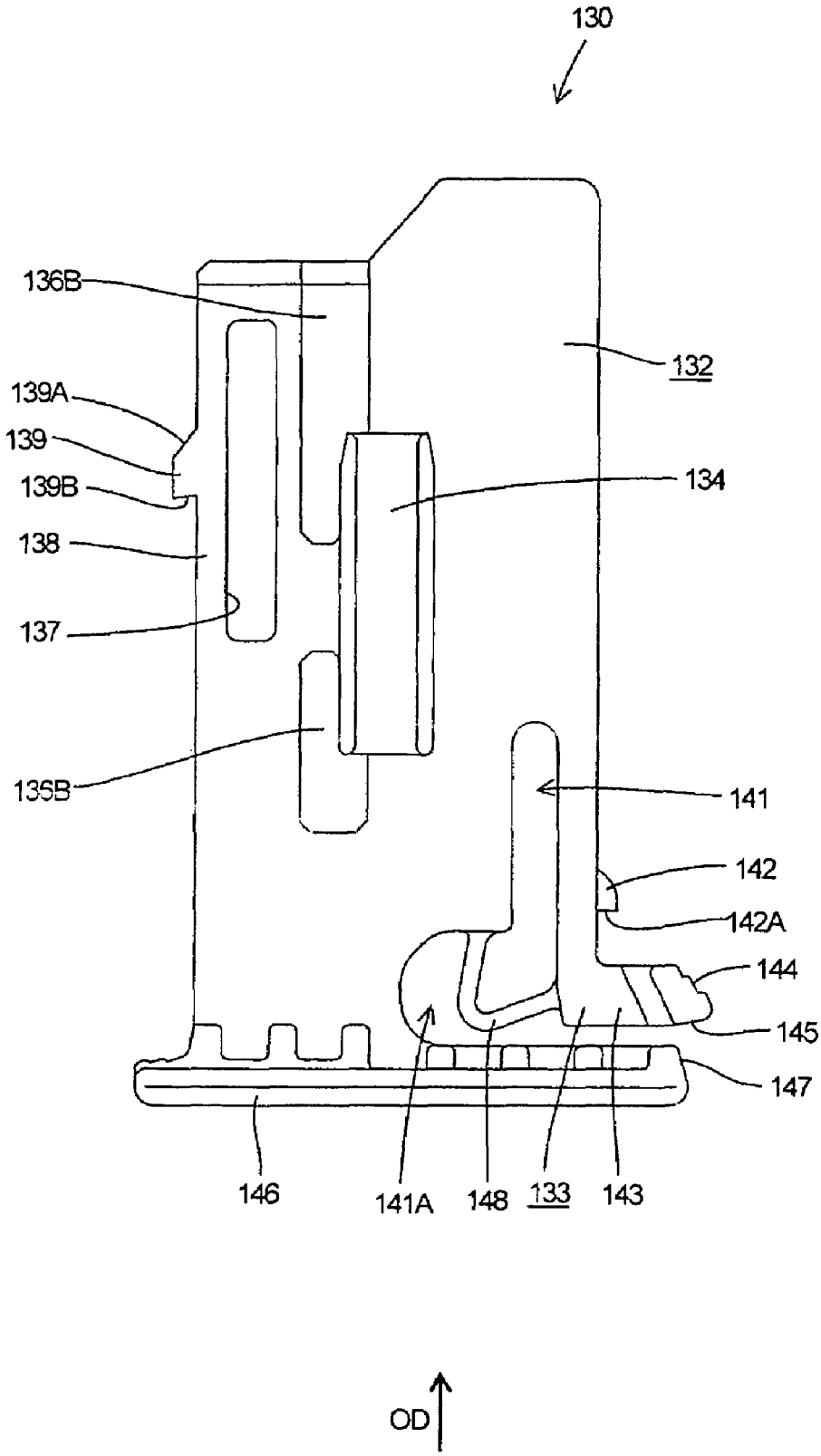
FIG. 27 is a bottom view of the slider.
Figure 28:
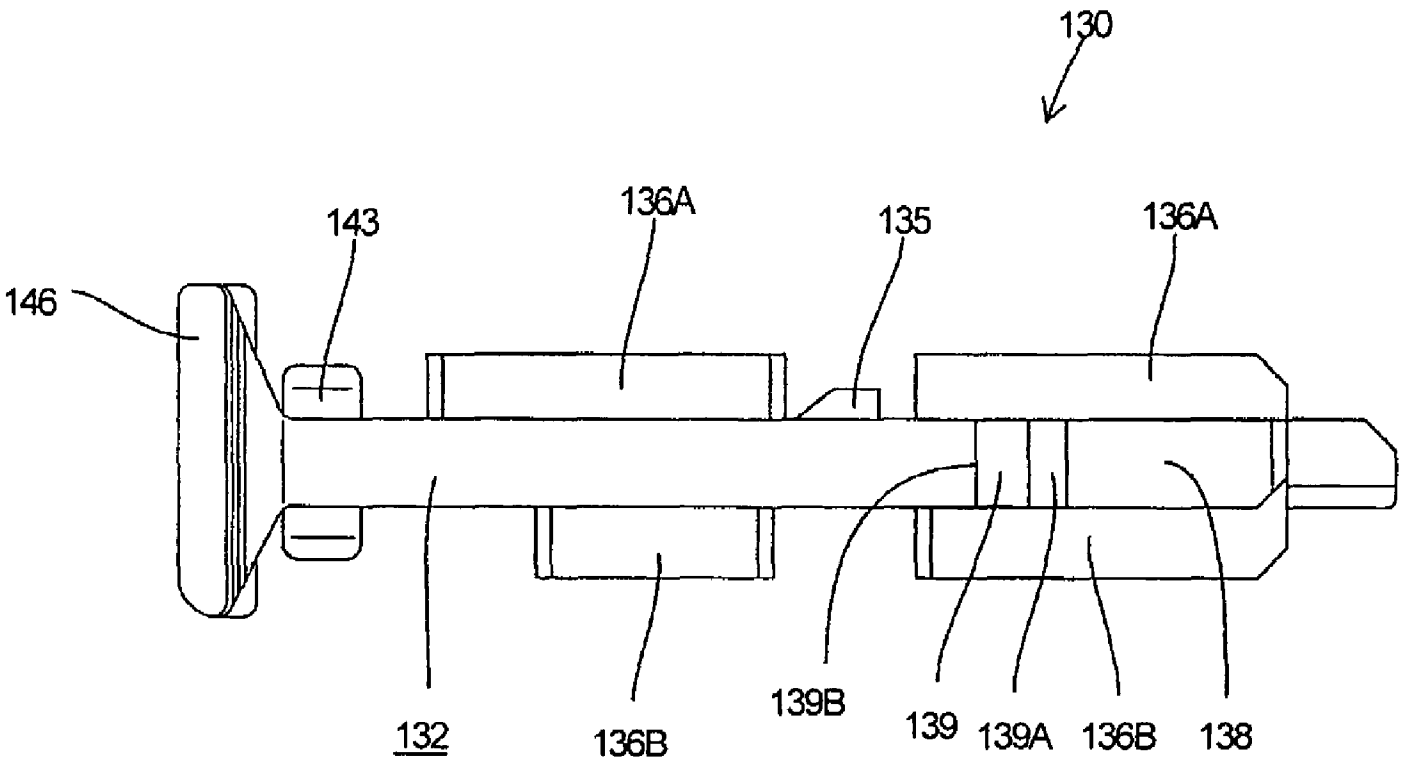
FIG. 28 is a front view of the slider.

The slider 130 is made e.g. of a synthetic resin and includes a main body 132 formed with a cam groove 131 and a lock arm 133 extending from the main body 132. As shown in FIGS. 26 to 28, the slider 130 including the lock arm 133 is a single substantially rectangular plate that is longer in an operating direction OD. The slider 130 is inserted into and withdrawn from the slider accommodating space 115 of the female housing 110 along the operating direction OD and substantially normal to the connecting direction CD of the housings 110, 150.

A resilient beam 134 is provided in an intermediate position of the main body 132 and is supported at opposite left and right ends. Thus, the resilient beam 134 is deformable along the vertical direction with its coupled left and right ends as supports. An upward projection 135 is formed on the upper surface of the resilient piece 134.

Figure 29:
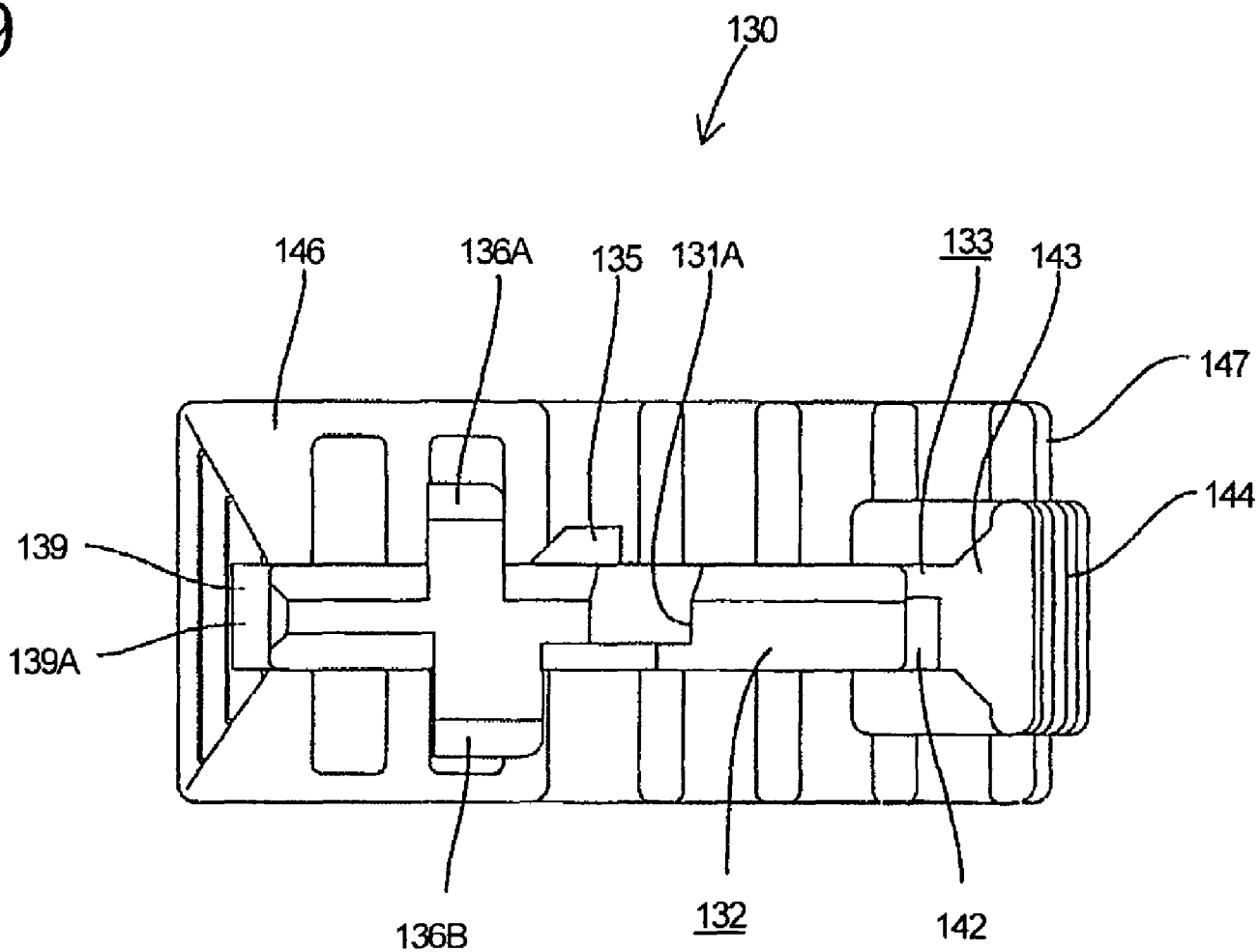
FIG. 29 is a side view of the slider when viewed from right.

Left and right upper-stage protrusions 136A and left and right lower-stage protrusions 136B are provided in front of the resilient piece 134. The upper-stage protrusions 136A and the lower-stage protrusions 136B are rectangular parallelepipeds that are narrow and long in the transverse direction and project up and down from the respective upper and lower surfaces of the main body 132, as shown in FIG. 28. The lower-stage protrusion 136B at the left of the projection 135 is slightly shorter in the transverse direction than the upper-stage protrusion 136A at the left of the projection 135. Further, as shown in FIG. 29, the lower-stage protrusions 136B are larger than the upper-stage protrusions 136A, and the front edges of the lower-stage protrusions 136B align vertically with those of the upper-stage protrusions 136A. In this way, the upper-stage and lower-stage protrusions 136A and 136B are formed to fit in the upper-stage and lower-stage communicating portions 115A and 115B of the slider accommodating space 115 in the female housing 110.

As shown in FIG. 26, a long narrow opening 137 is formed at a side of the upper-stage and lower-stage protrusions 136A, 136B substantially opposite the resilient piece 134. The opening 137 is at a front position with respect to the operating direction OD of the slider 130 and penetrates the main body 132 in the thickness direction. A resilient beam 138 extends across the opening 137 opposite the upper-stage and lower-stage protrusions 136A, 136B, and the resilient beam 138 is deformable towards the opening 137. A partial locking projection 139 projects from an intermediate position on the resilient beam 138 opposite the opening 137. A guiding slanted surface 139A is formed on the right side of the partial locking projection 139 and inclines down to the right, whereas a partial locking surface 139B if formed on the left side of the partial locking projection 139 and is aligned at substantially a right angle to the operating direction OD of the slider 130.

The cam groove 131 is recessed in the upper surface in the main body 132 of the slider 130 and at a side of the resilient piece 134 opposite the upper-stage and lower-stage protrusions 136A, 136B. The cam groove 131 is inclined obliquely back with respect to the operating direction OD of the slider 130 and to the back with respect to the connecting direction CD of the female housing 110 so that the housings 110, 150 are connected more as the slider 130 is moved laterally to the right. The entrance 131A of the cam groove 131 is substantially in the middle of the right) edge of the main body 132 with respect to forward and backward directions FBD, whereas an end of the cam groove 131 substantially opposite to the entrance 131A is at an intermediate position at a side corresponding to the rear side of the slider accommodating space 115.

The lock arm 133 is at the back of the cam groove 131 with respect to the operating direction OD of the slider 130 and is cantilevered back from an intermediate position of the main body 132. Additionally, the lock arm 133 is resiliently deformable along the thickness direction of the main body 132. An extending end of the lock arm 133 reaches the vicinity of the left edge of the main body 132.

A deformation space 141 of substantially constant width is defined between the lock arm 133 and the lateral edge of the main body 132. The deformation space 141 is open laterally and a left end portion thereof serves as a hinge accommodating portion 141A.

A lock projection 142 is provided at a lower position of a side surface of the lock arm 133 substantially opposite the deformation space 141 (see FIG. 29). The projecting height of the lock projection 142 is reduced at more forward positions with respect to the operating direction OD of the slider 130. A locking surface 142A is defined at the rear of the lock projection 142 with respect to the operating direction OD of the slider 130 and is aligned substantially normal to the operating direction OD. The lock projection 142 fits into the rear communicating portion 118B of the slider accommodating space 115 when the slider 130 is inserted completely to the full locking position, and the locking surface 142A faces the left surface of the rear communicating portion 118B to retain the slider 130. As a result, the slider 130 and the female housing 110 are locked in their properly connected state. Further, the lock arm 133 can be pressed toward the deformation space 141 to disengage the lock projection 142 from the rear communicating portion 118B to unlock the slider 130.

A hand-push portion 143 is at the extending end portion of the lock arm 133 and is bent toward a side opposite to the main body 132. The hand-push portion 143 can be pushed to operate the lock arm 133. The leading end of the hand-push portion 143 bulges up and down as shown in FIGS. 28 and 29 to define a finger contact surface 144 for receiving a finger to operate the hand-push portion 143. As shown in FIG. 26, the finger contact surface 144 has a stepped roughened antislip surface defined by projections inclined forward with respect to the inserting or operating direction OD.

The hand-push portion 143 projects to a side opposite to a resilient deforming side of the lock arm 133. An escaping surface 145 is formed at the leading end of the hand-push portion 143 and is inclined moderately forward at an angle of between about 10° to about 30° toward the leading end with respect to the operating direction OD of the slider 130. An external force that acts on the escaping surface 145 from the rear with respect to the operating direction OD of the slider 130 has a component that acts in a direction as to displace the lock arm 133 towards the deformation space 141.

A substantially rectangular plate-shaped cover 146 is provided at the rear of the main body 130 with respect to the operating direction OD of the slider 130 and extends substantially normal to the plane of the main body 132. As shown in FIG. 27, the cover 146 bulges laterally from the main body 132 and is spaced slightly from the end of the lock arm 133. The cover 146 covers the rear end of the main body 132 and substantially the entire lock arm 133 except for the escaping surface 145 at the leading edge of the hand-push portion 143. The cover 146 doubles as a pushable wall and can be pushed by a finger for inserting the slider 130 into the slider accommodating space 115. A finger supporting surface 147 is formed at an outer surface of the cover 146 near the hand-push portion 143 and can be operated during unlocking from a location near where the finger has pushed the hand-push portion 143 for unlocking. The finger supporting surface 147 is inclined down towards the main body 132. With the hand-push portion 143 pushed to unlock the slider 130, the finger contact surface 144 and the finger supporting surface 147 constitute a downward slope continuous towards the front with respect to the operating direction OD of the slider 130. Thus, both the finger contact surface 144 and the finger supporting surface 147 extend substantially along a finger placed obliquely from the finger contact surface 144 of the hand-push portion 143 to the finger supporting surface 147 of the cover 146.

The lock arm 133 and the main body 132 are coupled by a hinge 148. One end of the hinge 148 is coupled to the extending end of the lock arm 133 and the other end is coupled to a part of the outer surface of the main body 132 corresponding to the hinge accommodating portion 141A. the hinge 148 has a substantially bent- or U- or V-shape with a bend in the hinge accommodating portion 141A. The hinge 148 has a length as to stretch out before the lock arm 133 is deformed plastically away from the main body 132.

Figure 30:
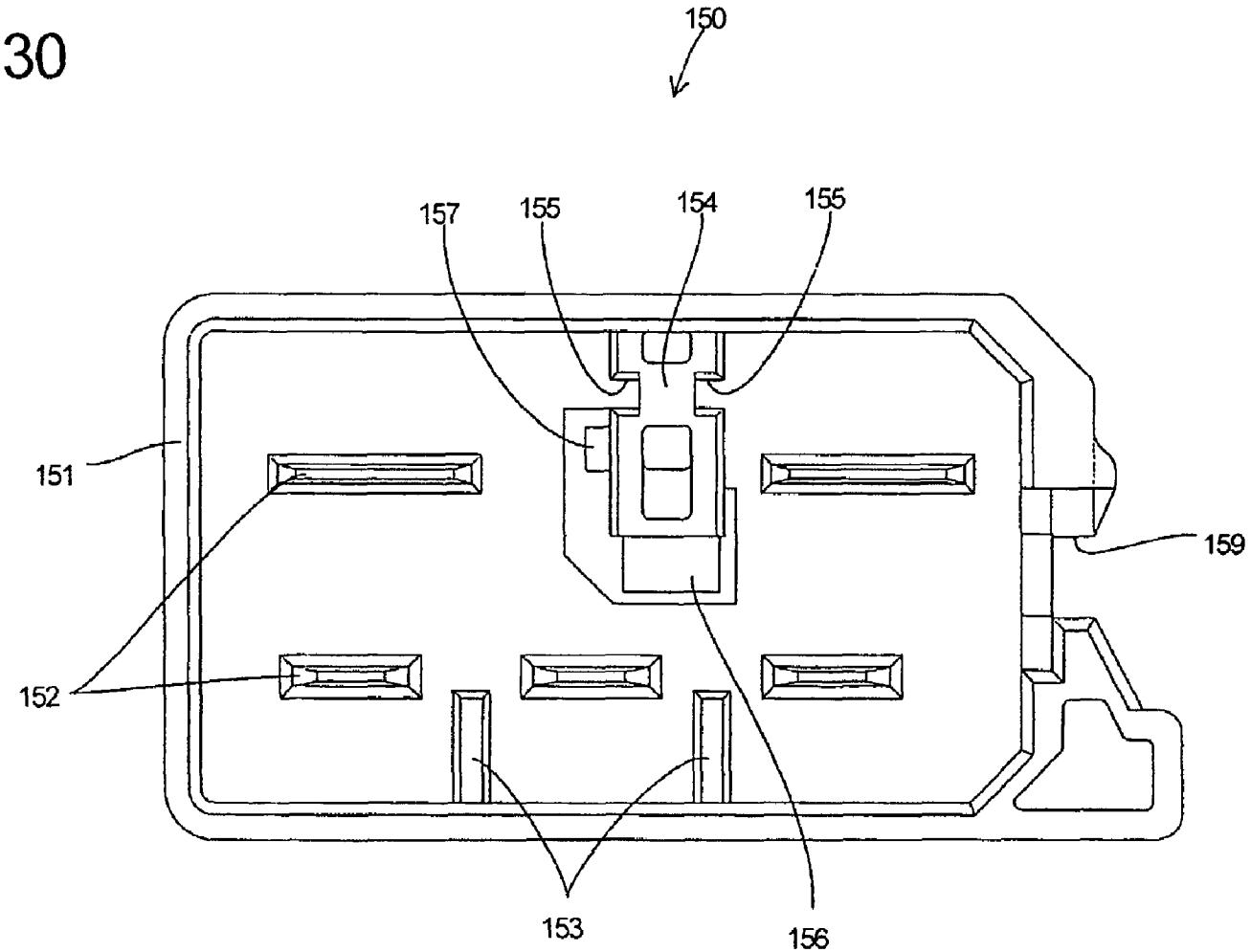
FIG. 30 is a front view of a male housing.
Figure 31:
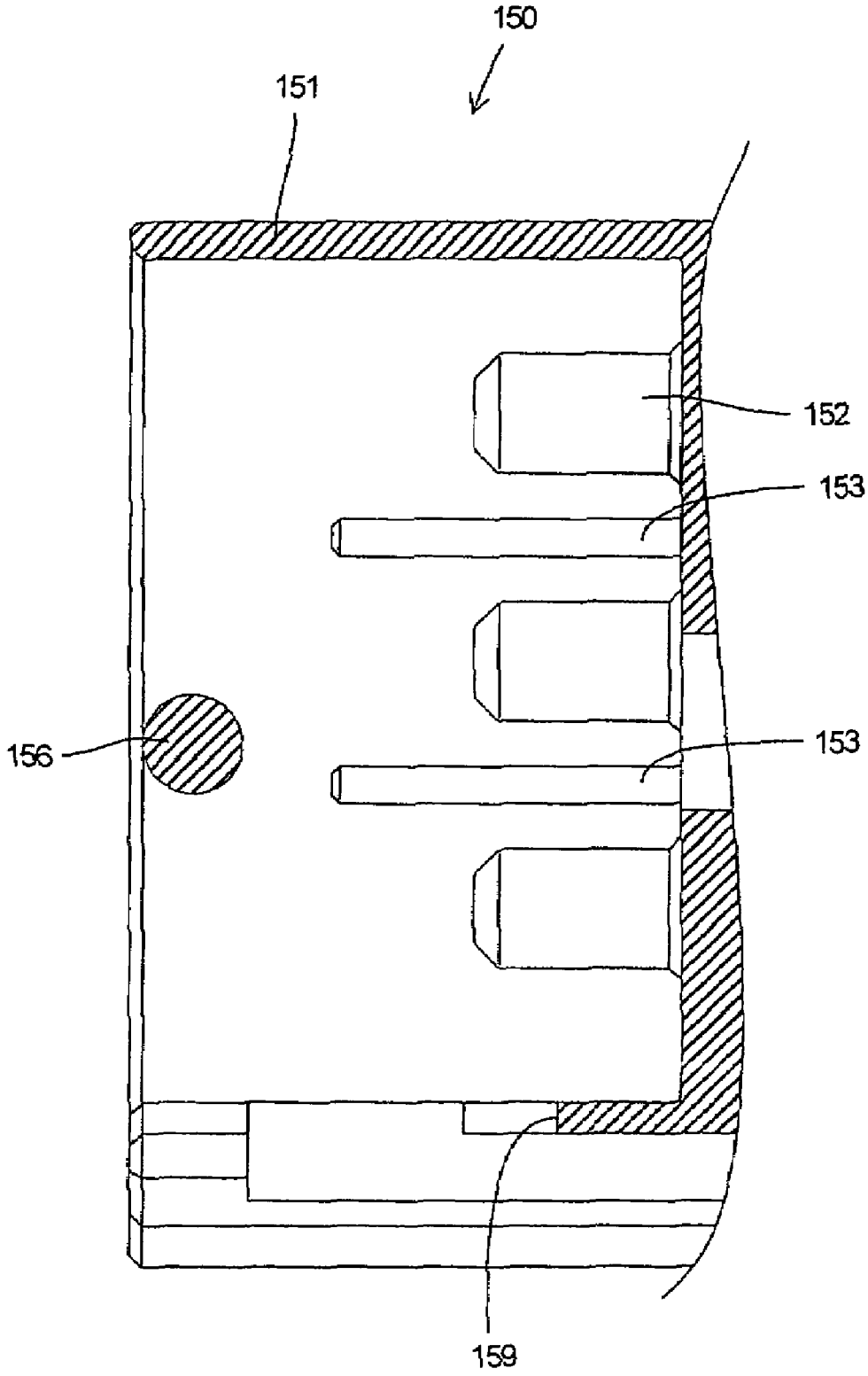
FIG. 31 is a plan view in section of the male housing.
Figure 32:
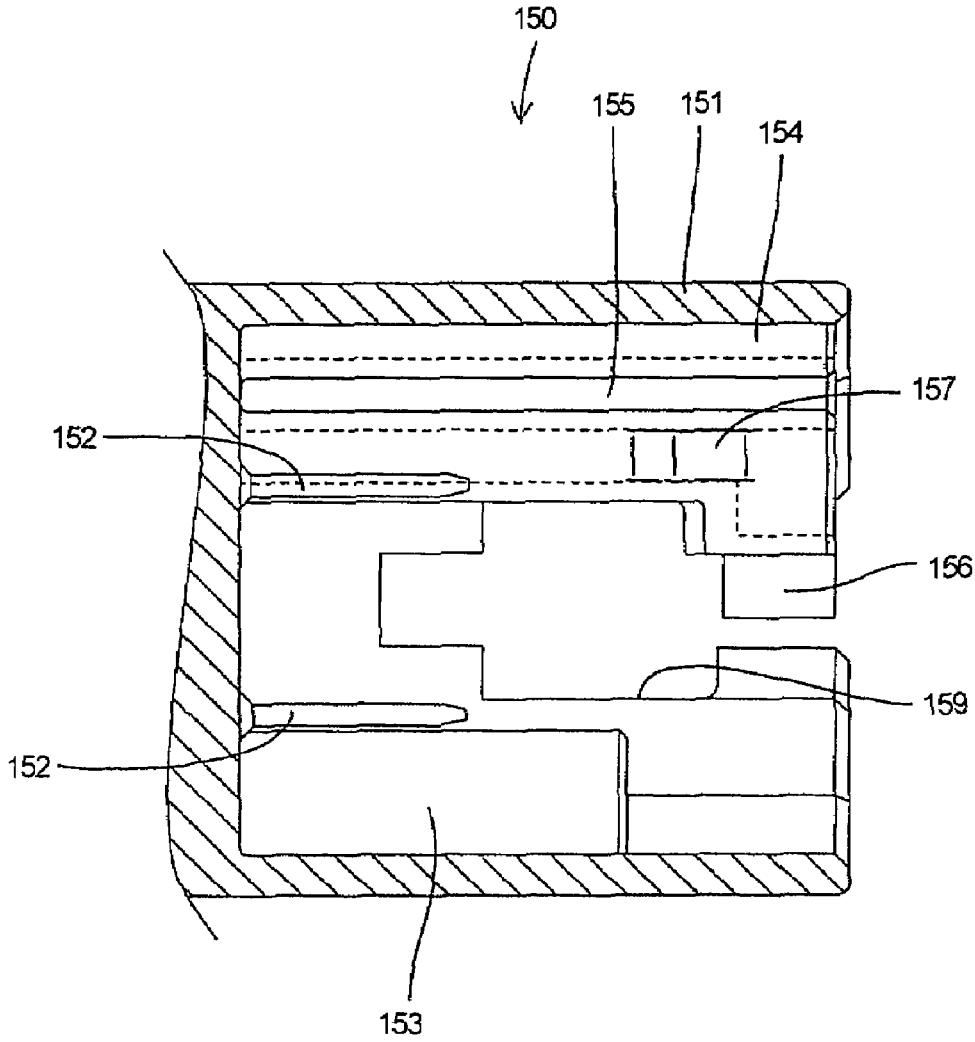
FIG. 32 is a side view in section of the male housing.

The male housing 150 is to be mounted fixedly on an automotive device (not shown) and includes a receptacle 151 in the form of a substantially rectangular tube projecting forward from the wall of the device, as shown in FIGS. 30 to 32. Male terminal fittings 152 having tab-shaped leading ends are mounted in the male housing 150. The male terminal fittings 152 project forward in a space enclosed by the receptacle 151, and are arranged at upper and lower stages corresponding to the female terminal fittings 112.

Ribs 153 are provided on the bottom wall of the receptacle 151 and extend in forward and backward directions FBD. Each rib 153 is arranged between two adjacent male terminal fittings 152 arranged at the lower stage, and is fitted into the corresponding vertical groove 114 of the female housing 110 during a connecting operation of the two housings 110, 140 to prevent a forcible connection.

A support 154 projects down from the ceiling wall of the receptacle 151 between two male terminal fittings 152 at the upper stage. The support 154 extends from the front edge to the rear edge of the receptacle 151 and has a substantially rectangular front section slightly longer in the vertical direction. Two long narrow grooves 155 are formed in the opposite left and right surfaces of the support 154 and extend in forward and backward directions FBD. The bulges 120 in the cam-pin introducing path 119 can fit into the grooves 155.

A cam pin 156 projects down and in from a position near the front end of the support 154. The cam pin 156 is substantially cylindrical and has an axis line that extends substantially vertically and substantially normal to the connecting directions CD of the two housings 110, 150.

A curved projection 157 projects at a position near the front of the support 154 and has a moderate mountain or pointed shape. The curved projection 157 is below the right groove 155.

A slot 159 is formed in the left wall of the receptacle 151 and extends back from the front edge of the receptacle 151 to avoid interference with the slider 130 during the connection of the two housings 110, 150.

Operation of this embodiment is described with reference to FIGS. 33 to 37. First, the female terminal fittings 112 are inserted into the respective cavities 111 from behind and along the inserting direction ID. After all the female terminal fittings 112 are inserted, the slider 130 is inserted into the slider entrance 117 in the operating direction OD in an orientation so that the upper-stage and the lower-stage protrusions 136A, 136B fit into the upper-stage and lower-stage communicating portions 115A, 115B. The cover 146 is pushed gradually by a finger to insert the slider 130 in the operating direction OD through the slider entrance 117.

Figure 33:
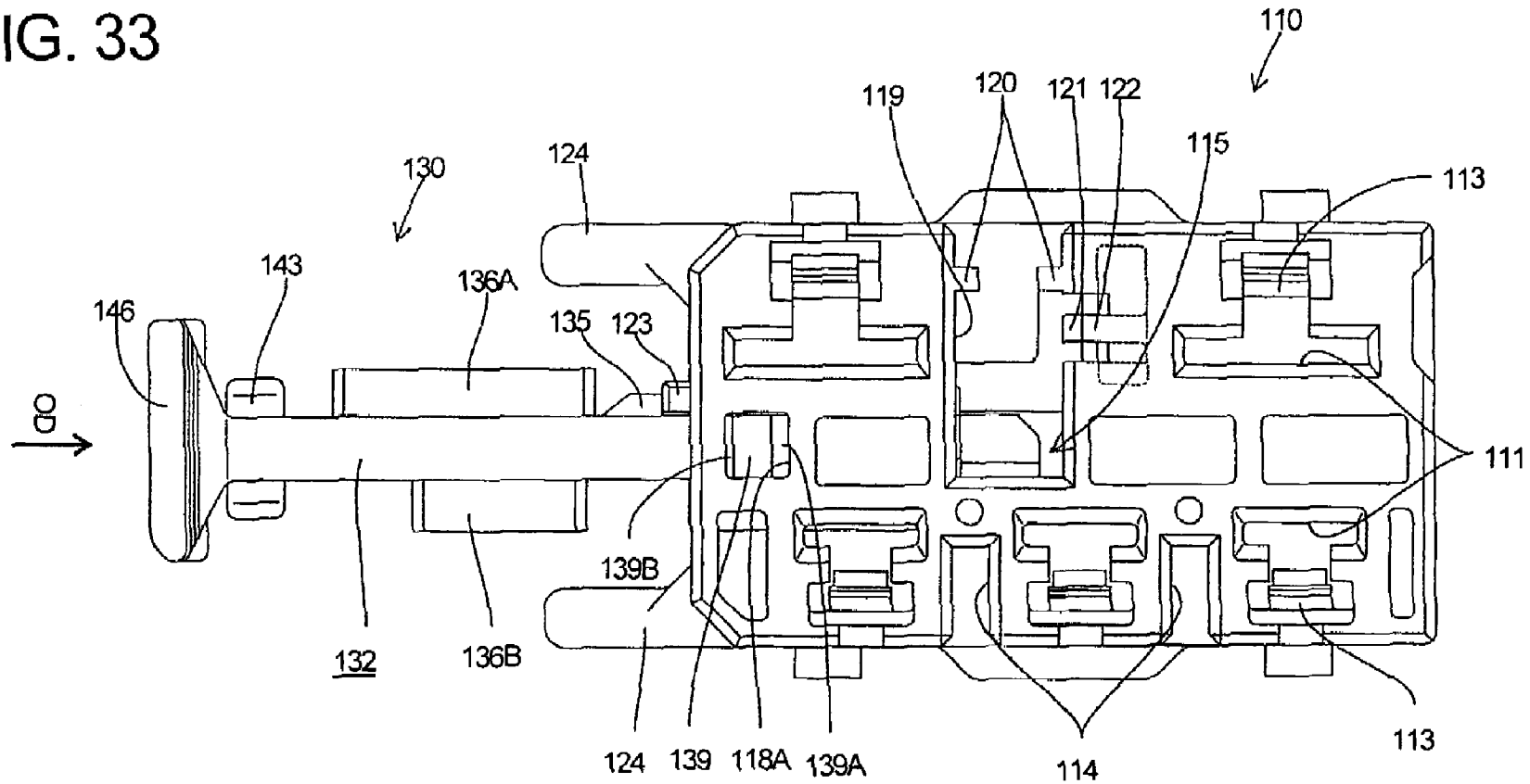
FIG. 33 is a front view showing a state where the slider is inserted to a partial locking position in the female housing.
Figure 34:
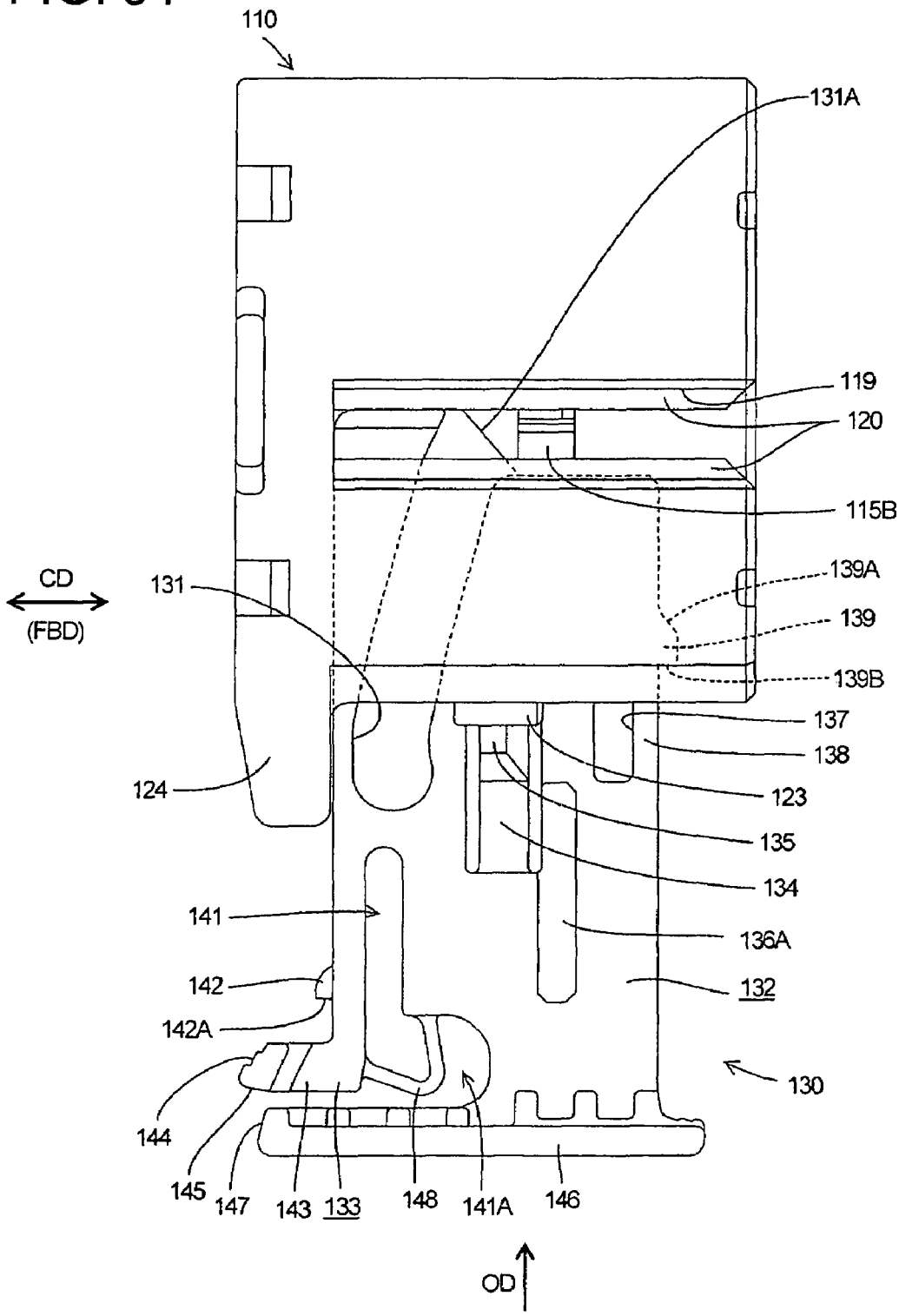
FIG. 34 is a plan view showing the state where the slider is inserted to the partial locking position in the female housing.

The guiding slanted surface 139A of the partial locking projection 139 on the slider 130 contacts the peripheral edge of the slider entrance 117 and deforms the resilient beam 138 as the slider 130 is inserted. The resilient beam 138 is restored resiliently when the partial locking projection 139 moves beyond the peripheral edge, so that partial locking projection 139 moves to the front communicating portion 118A. Then, as shown in FIGS. 33 and 34, the partial locking surface 139B of the partial locking projection 139 faces the left surface of the front communicating portion 118A and, simultaneously, the projection 135 on the upper surface of the slider 130 contacts the temporary contact portion 123 along the upper edge of the slider entrance 117. At this time, the entrance 131A of the cam groove 131 is in the cam-pin introducing path 119 so that the cam pin 156 of the male housing 150 can engage the cam groove 131. In this way, the slider 130 reaches the partial locking position to wait on standby for the engagement with the cam pin 156 and is held in the slider accommodating space 115 while having transverse movements thereof prevented.

The female housing 110 next is transported to an assembling site with the male housing 150 for connection with the male housing 150. At this time, a rear portion of the slider 130 with respect to the operating direction OD is exposed. However, the cover 146 covers most of the lock arm 133 from behind. Hence, external matter that approaches from behind will contact the cover 146, thereby preventing the lock arm 133 from being directly interfered with, damaged or operated. There is a high possibility that external matter approaching from a side opposite to the deformation space 141 will contact the outer periphery of the cover 146 before interfering with the lock arm 133. Thus, external matter is less likely to contact the lock arm 133 as compared with a case where the lock arm is exposed. Accordingly, the cover 146 provides good protection for the lock arm 133 as compared to a lock arm that is exposed.

External matter approaching from behind may contact the leading edge of the hand-push portion 143 not covered by the covering 146, but will contact the escaping surface 145 formed at the leading edge. Then, a component of force acting toward the deformation space 141 may be created on the escaping surface 145 from an external force acting forward from the back. Since the lock arm 133 is displaced toward the deformation space 141, i.e. in its specified resiliently deforming direction by this component of force, a displacement of the lock arm 133 in a direction opposite to the specified resiliently deforming direction can be avoided.

Even if the lock arm 133 should be displaced in the opposite direction, the hinge 148 prevents plastic deformation of the lock arm 133.

Figure 35:
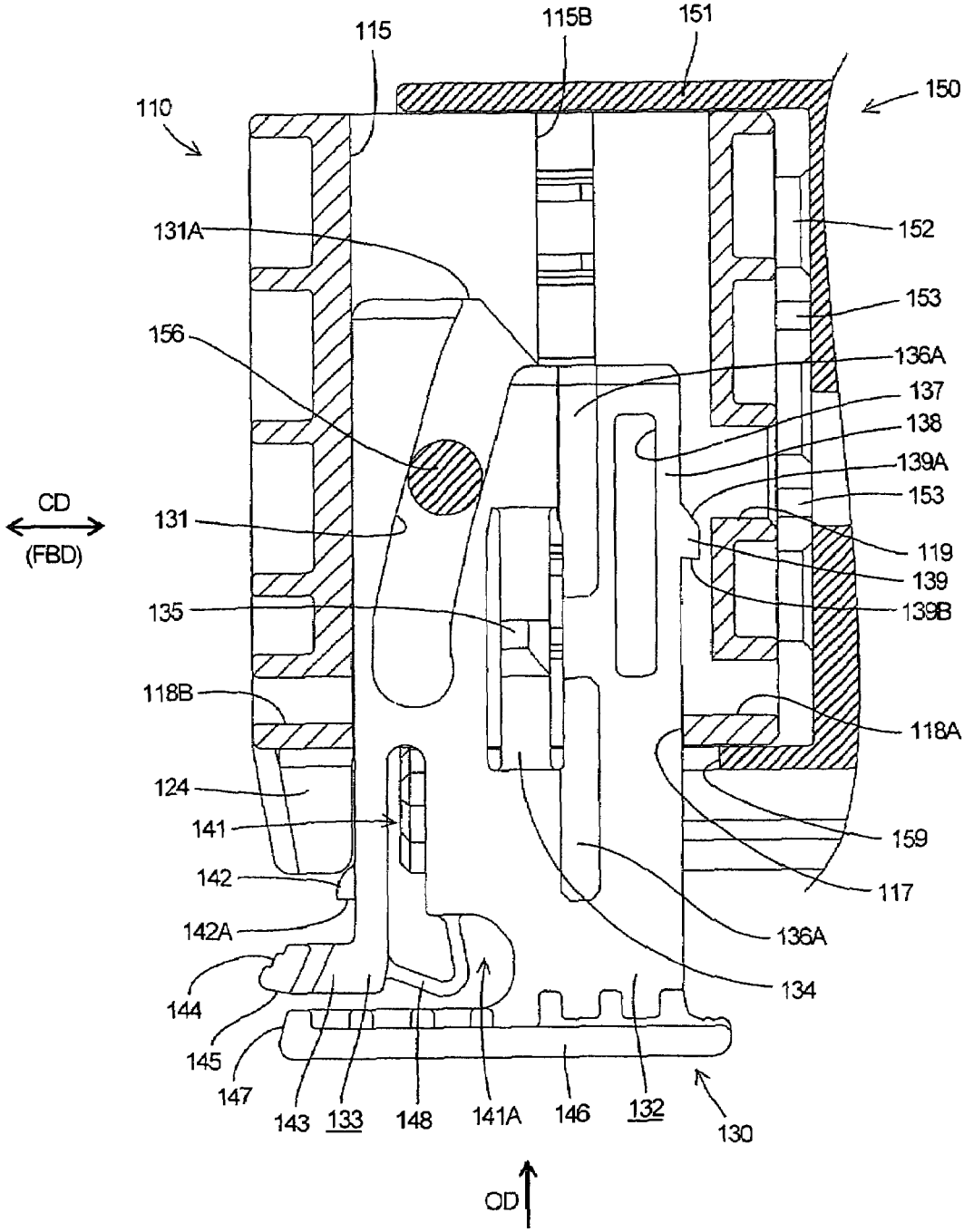
FIG. 35 is a plan view in section showing an intermediate state when the slider is moved from the partial locking position to a full locking position.

The female housing 110 first is fit lightly into the receptacle 151 so that the cam pin 156 enters the cam-pin introducing path 119. The two housings 110, 150 are brought closer together until the cam pin 156 reaches the entrance 131A of the cam groove 131. At this time, the curved projection 157 moves beyond the mountain portion 121 and the operator feels the introduction of the cam pin 156 into the entrance 131A of the cam groove 131. The cover 146 of the slider 130 is pushed after the cam pin 156 engages the cam groove 131. The resilient piece 134 of the slider 130 then is deformed down and the projection 135 moves over the temporary contact 123. As a result, the slider 130 is freed from the partly locked state and pushed to the right. This movement of the slider 130 generates a cam action between the cam groove 131 and the cam pin 156 that pulls the female housing 110 and the male housing 150 towards each other, as shown in FIG. 35.

Figure 36:
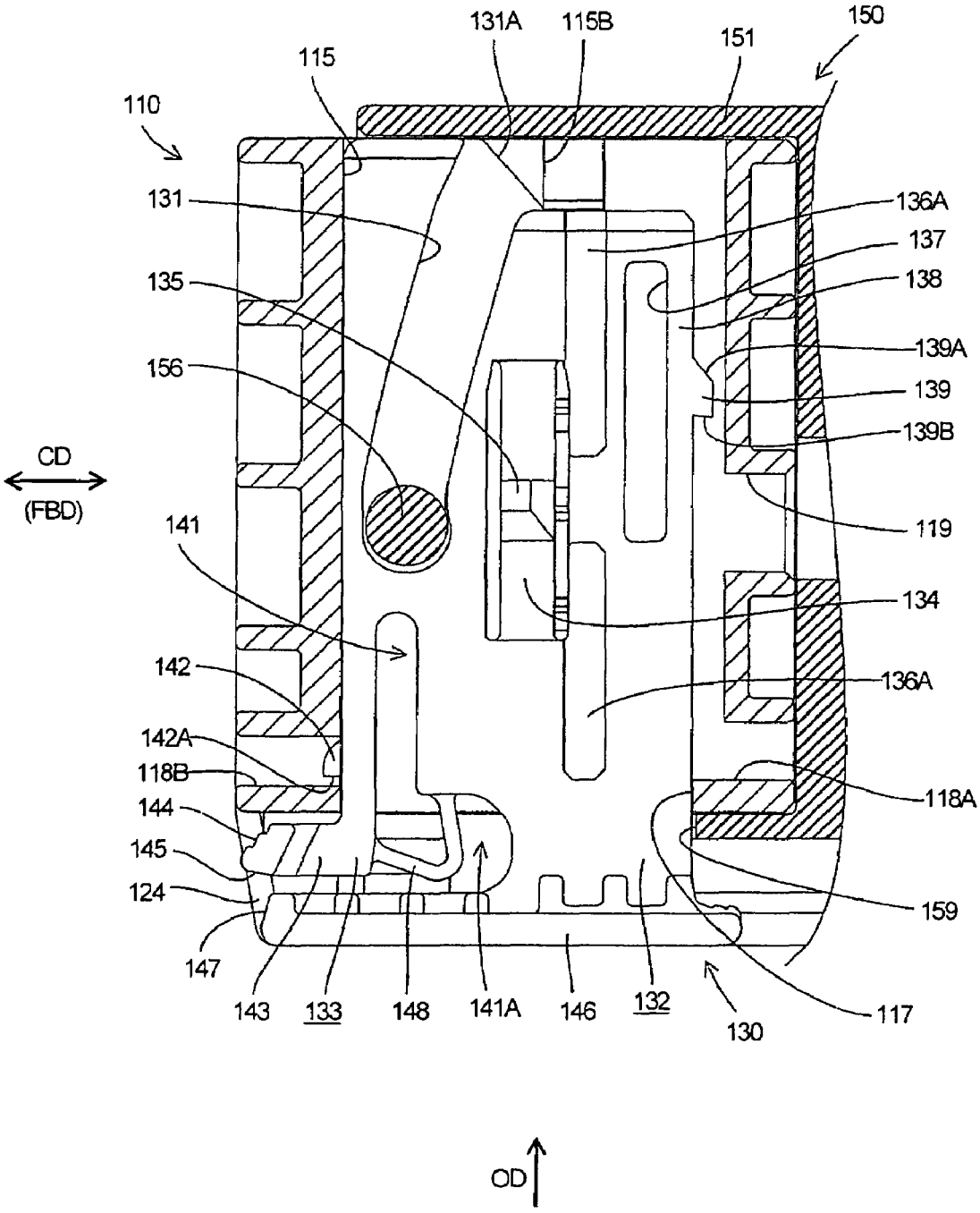
FIG. 36 is a plan view in section showing a state where the slider is at the full locking position.

The lock 142 of the lock arm 133 contacts the peripheral edge of the slider entrance 117 when a large part of the slider 130 is in the slider accommodating space 115. Further movement of the slider 130 causes the lock arm 133 to deform towards the deformation space 141 and the lock projection 142 moves beyond the peripheral edge. The lock arm 133 restores resiliently after the lock 142 moves over the peripheral edge, and the lock 142 is fit into the rear communicating portion 118B, as shown in FIG. 36. The locking surface 142A of the lock 142 then faces the left surface of the rear communicating portion 118B to lock the slider 130 and the female housing 110 in their connected state. By this time, the slider 130 has reached the full locking position where the right edge thereof is covered by the receptacle 151 of the male housing 150 at the right opening of the slider accommodating space 115, and the connected housings 110, 150 connect the female terminal fittings 112 and the male terminal fittings 152 electrically. The housings 110, 150 are locked together and connected when the slider 130 reaches the full locking position.

The hand-push portion 143 of the lock arm 133 is protected laterally by the projections 124 on the female housing 110 when the two housings 110, 150 are connected properly, as shown in FIG. 19. Further, engaged parts of the cam groove 131 and the cam pin 156 are concealed by the receptacle 151.

Figure 37:
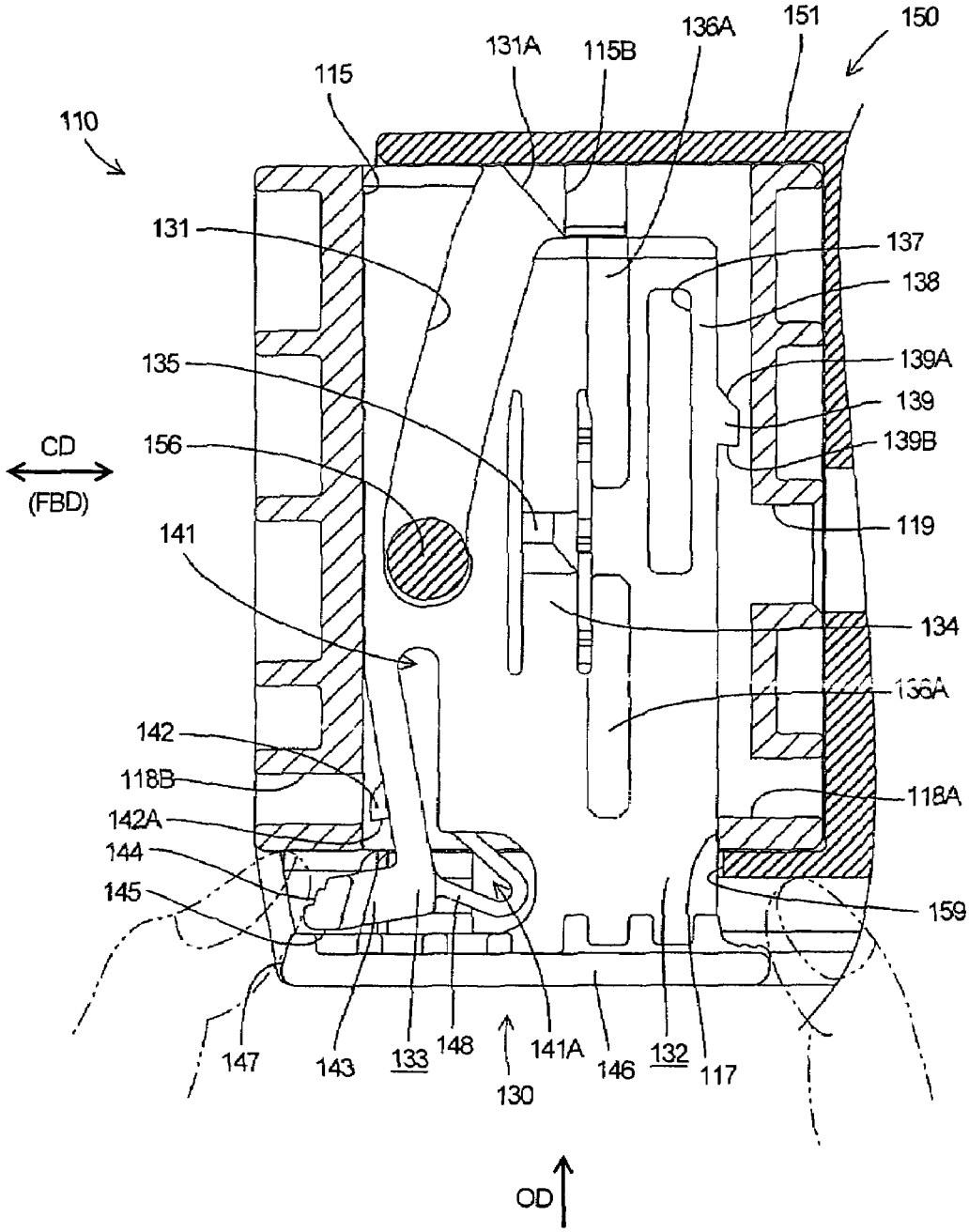
FIG. 37 is a plan view in section showing a state where the slider is being pulled out.

Upon separating the two housings 110, 150, the cover 146 of the slider 130 is gripped from front and back by the fingers, as shown in FIG. 37. The tip of one finger is placed on the finger contact surface 144 formed on the leading end of the hand-push portion 143. Subsequently, the finger on the finger contact surface 144 is pushed toward the main body 132, thereby unlocking the lock arm 133, and the slider 130 is pulled out in this state by pulling the cover 146 gripped by the fingers. At this time, the finger having pushed the hand-push portion 143 is supported on the finger supporting surface 147 on the outer surface of the cover 146 since the hand-push portion 143 is near the cover 146 and the leading end of the hand-push portion 143 projects out more than the outer edge of the cover 146. In this way, the finger having pushed the hand-push portion 143 is supported on a fixed member, such as the cover 146, and the lock arm 133 can be unlocked by hooking the finger on the cover 146. Therefore, the slider 130 can be or pulled out easily as compared to a case where the finger is unstably hooked on the resiliently deformed lock arm 133.

Further, when the hand-push portion 143 is pushed to unlock the lock arm 133, the finger contact surface 144 of the hand-push portion 143 and the finger supporting surface 147 of the cover 146 constitute a downward slope continuous toward the front side with respect to the operating direction OD of the slider 130, and the finger is placed obliquely from the outer edge of the cover 146 to the leading end of the hand-push portion 143. Thus, the finger fits well. In addition, the finger contact surface 144 of the hand-push portion 143 is stepped and the finger is unlikely to slip because of a larger frictional force to the finger as compared to a case where this surface is flat. Accordingly, the slider 130 can be easily pulled out.

In this way, the unlocked slider 130 is pulled out of the slider accommodating space 115. As the slider 130 is pulled out, the female housing 110 and the male housing 150 are separated gradually by the cam action resulting from the engagement of the cam groove 131 and the cam pin 156.

As described above, the lock arm 133 is covered from behind by the cover 146. Thus, the lock arm 133 is protected from interference of external matter, as compared to a case where the lock arm is exposed.

Further, the slider 130 is inserted into the slider accommodating space 115 in the operating direction OD by pushing the cover 146 by the fingers. Thus, the cover 146 doubles as the pushable wall to push the slider 130. It is not necessary to provide an additional member for the pushing operation and the construction of the slider 130 is simplified.

The cover 146 has an area for covering the lock arm 133 and the main body 132 laterally and is formed by extending a preexisting pushable portion. Thus, a pushable surface where the fingers can be placed is wide and the slider 130 can be inserted easily.

The hand-push portion 143 of the lock arm 133 is near the cover 146 and projects beyond the outer edge of the cover 146. Thus, the finger having pushed the hand-push portion 143 at the time of unlocking is supported on or at the outer edge of the cover 146, and the slider 130 can be pulled out easily by hooking the finger on the cover 146.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the hand-push portion 143 of the lock arm 133 projects more than the outer edge of the cover 146 in the foregoing embodiment, the invention is not limited thereto, and the hand-push portion may be lower than the outer edge of the cover although it unavoidably leads to slight difficulty to pull the slider out. In such a case, the escaping surface 145 can be omitted.

In the foregoing embodiment, the finger contact surface 144 of the hand-push portion 143 and the finger supporting surface 147 of the cover 146 are inclined toward the main body 132 and toward the front with respect to the inserting direction of the slider 130, and the finger contact surface 144 is stepped, so that the finger can fit better. Both or one of the surfaces may not be inclined and/or the finger contact surface may not be stepped.

Although the lock arm 133 and the main body 132 are coupled by the hinge 148 in the foregoing embodiment, a displacement restricting member capable of restricting a displacement of the lock arm in the direction opposite to the specified resiliently deforming direction may be, for example, provided on the lock arm instead of the hinge 148.

Although in the above embodiment, the movable member is a slider, it should be understood that the invention is applicable to any movable member displaying a cam action other than a slider such as a rotatable lever or the like.

Figure 38:
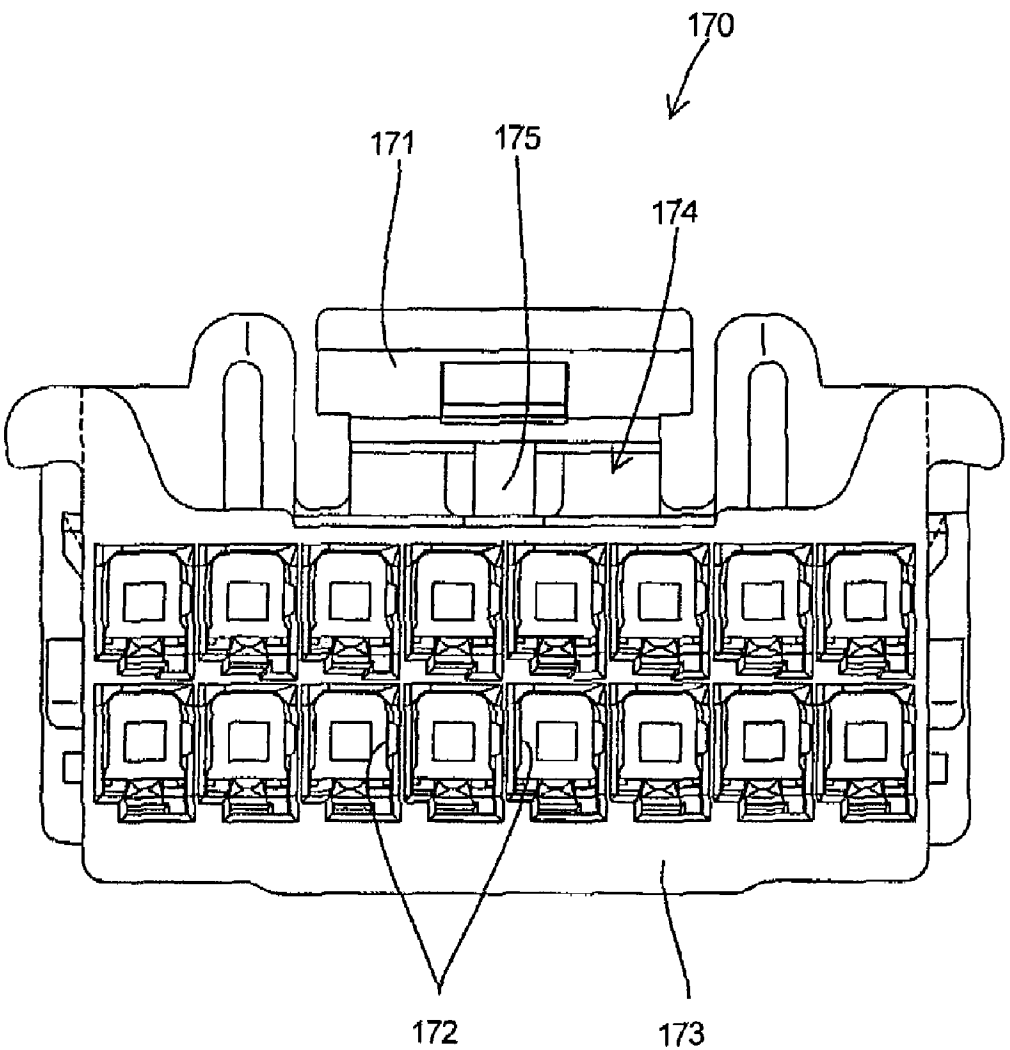
FIG. 38 is a front view of a housing according to another embodiment.
Figure 39:
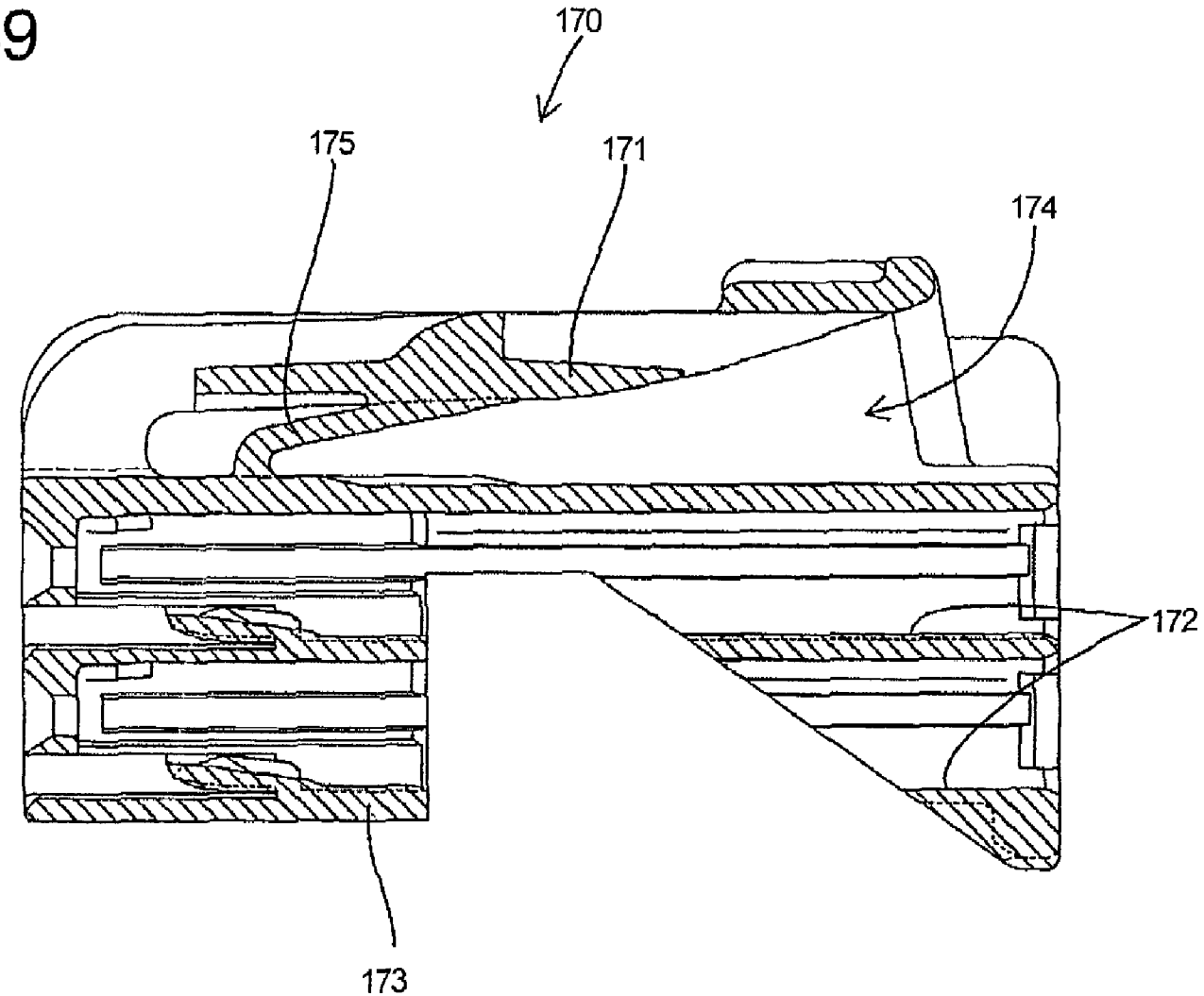
FIG. 39 is a side view in section of the housing according to another embodiment of the invention.

Although the invention of coupling a lock arm and a main body by a hinge 148 is applied to the lock arm of the slider in the foregoing embodiment, the invention may be applied to a lock arm 171 of an ordinary connector housing 170, as shown in FIGS. 38 and 39. This housing 170 is provided with a main body 173 including cavities 172, and the cantilevered lock arm 171 defining a deformation space 174 to the main body 173. Similar to the foregoing embodiment, this lock arm 171 is deformed toward the deformation space 174 upon connecting the housing 170 with a mating housing (not shown) while being resiliently deformed to engage the mating housing when the two housings are connected properly. Further, the lock arm 171 and the main body 173 are coupled via a hinge 175 similar to the foregoing embodiment. The hinge 175 is provided at a position near connected parts of the lock arm 171 and the main body 173, i.e. near the base end of the lock arm 171. Similar to the foregoing embodiment, the hinge 175 prevents excessive displacement of the lock arm 171, and prevents the lock arm 171 from being excessively displaced in a direction opposite to a specified resiliently deforming direction due to the interference of an external matter and from being damaged. The position of the hinge 175 is not limited to the one near the base end of the lock arm 171. For example, the hinge 175 may be near an extending end of the lock arm.

What is claimed is:

1. A connector, comprising:

a housing connectable with a mating housing; and a movable member with at least one main body having opposite front and rear ends and at least one cam engageable with a mating cam of the mating housing, the movable member being movable with respect to the housing in operating directions intersecting connecting directions of the housings, the movable member being operated by pushing a cover at the rear end of the main body of the movable member with respect to the operating direction, the housing being connected with and separated from the mating housing by a cam action of the cam and the mating cam upon operation of the movable member;

the movable member including at least one lock arm extending rearwardly from a location on the main body of the movable member between the front and rear ends of the movable member and having a free rear end spaced forwardly of the cover of the movable member, the lock arm defining a deformation space to the main body, portions of the lock arm adjacent the free rear end thereof being resiliently deformable in a direction at an angle to the operating direction, and being unlocked upon being pushed towards the deformation space;

the housing including at least one lock engagable with the lock arm upon complete operation of the movable member; and the cover at least partly covering the free rear end of the movable member from behind with respect to the operation direction of the movable member, the cover defining an operable wall for operating the movable member.

2. The connector of claim 1, wherein the movable member comprises a slider insertable into the housing in directions intersecting connecting directions of the housings.

3. The connector of claim 2, wherein the slider is inserted into the housing by pushing a rear part of the slider with respect to the operating direction.

4. The connector of claim 1, wherein the movable member is substantially plate-like and the lock arm is resiliently deformable in a direction along a plate surface of the main body.

5. The connector of claim 1, wherein the lock arm includes at least one hand-push portion for pushing at the free rear end of the lock arm and near the cover, the hand-push portion having a height to project more than a leading edge of the cover in a direction opposite to the resiliently deforming direction of the lock arm.

6. The connector of claim 1, wherein the lock arm and the main body are coupled by at least one coupling permitting the lock arm to deformed and capable of preventing the lock arm from plastically deforming in a direction away from the deformation space.

7. The connector of claim 1, wherein all parts of the cam are formed of the lock arm.

8. The connector of claim 1, wherein the lock arm is rearward of the cam.

9. A connector of claims 5, wherein comprising:

a housing connectable with a mating housing;

a movable member with at least one main body having at least one cam engageable with a mating cam of the mating housing, and movable with respect to the housing in operating directions intersecting connecting directions of the housings, at least one hand-push portion provided at a rear part of the movable member for pushing the movable member with respect to the operating direction;

the housing being connected with and separated from the mating housing by a cam action of the cam and the mating cam upon operation of the movable member;

the movable member including at least one lock arm defining a deformation space to the main body, the lock arm being resiliently deformable in a direction along the main body, and unlocked upon being pushed towards the deformation space:

the housing including at least one lock engageable with the lock arm upon complete operation of the movable member; and at least one cover at a back side of the movable member with respect to the operation direction and at least partly covering the movable member from behind with respect to the operation direction of the movable member, the cover defining an operable wall for operating the movable member, the hand-push portion of the lock arm being provided at a position on the lock arm near the cover and having a height to proiect more than a leading edge of the cover in a direction opposite to the resilient deforming direction of the lock arm, finger placing surfaces are being formed on a projecting end of the hand-push portion and the leading edge of the cover and have a downward slope substantially continuous towards the front with respect to the operating direction of the movable member when the lock arm is pushed to be unlocked.

10. The connector according to claim 9, wherein the finger placing surface of the hand-push portion is an uneven surface.

11. A connector a housing connectable with a mating housing;

a movable member with at least one main body having at least one cam engageable with a mating cam of the mating housing, and movable with respect to the housing in operating directions intersecting connecting directions of the housings, at least one hand-push portion provided at a rear part of the movable member for pushing the movable member with respect to the operating direction;

the housing being connected with and separated from the mating housing by a cam action of the cam and the mating cam upon operation of the movable member;

the movable member including at least one lock arm defining a deformation space to the main body, the lock arm being resiliently deformable in a direction along the main body, and unlocked upon being pushed towards the deformation space;

the housing including at least one lock engageable with the lock arm upon complete operation of the movable member; and at least one cover at a back side of the movable member with respect to the operation direction and at least partly covering the movable member from behind with respect to the operation direction of the movable member, the cover defining an operable wall for operating the movable member, the hand-push portion of the lock arm being provided at a position on the lock arm near the cover and having a height to project more than a leading edge of the cover in a direction opposite to the resilient deforming direction of the lock arm, an inclined surface is being formed on a rear part of the hand-push portion projecting more than the leading edge of the cover with respect to the operating direction of the movable member for creating a component of force to displace the lock arm towards the deformation space when an external force acts thereon in a direction along the operating direction.

* * * * *